US007712633B2

(12) United States Patent
Kennedy et al.

(10) Patent No.: US 7,712,633 B2
(45) Date of Patent: May 11, 2010

(54) THROUGH-PUMP LIQUID DRAIN-BACK SYSTEM FOR A DISPENSING PACKAGE

(75) Inventors: Timothy Kennedy, Pleasanton, CA (US); Tami O'Connell, Pleasanton, CA (US)

(73) Assignee: The Clorox Company, Oakland, CA (US)

( * ) Notice: Subject to any disclaimer, the term of this patent is extended or adjusted under 35 U.S.C. 154(b) by 398 days.

(21) Appl. No.: 11/772,320

(22) Filed: Jul. 2, 2007

(65) Prior Publication Data

US 2009/0014474 A1 Jan. 15, 2009

(51) Int. Cl.
*B67D 7/60* (2010.01)
*B43M 11/06* (2006.01)

(52) U.S. Cl. ..... 222/110; 222/109; 222/205; 222/321.3; 222/321.6; 222/375

(58) Field of Classification Search ..... 222/108, 222/109, 110, 205, 321.3, 321.6, 375, 571
See application file for complete search history.

(56) References Cited

U.S. PATENT DOCUMENTS

| | | | | | |
|---|---|---|---|---|---|
| 705,336 | A | * | 7/1902 | Furber | 222/109 |
| 721,112 | A | * | 2/1903 | Weaver et al. | 222/205 |
| 1,775,423 | A | * | 9/1930 | Donovan et al. | 222/111 |
| 1,850,870 | A | * | 3/1932 | Featherstone | 222/205 |
| 2,000,493 | A | * | 5/1935 | Miller | 222/205 |
| 2,554,658 | A | * | 5/1951 | Bolsey | 222/205 |
| 2,593,591 | A | * | 4/1952 | Menkin et al. | 222/205 |
| 2,774,517 | A | * | 12/1956 | Teegardin et al. | 222/205 |
| 3,739,955 | A | * | 6/1973 | Gores | 222/205 |
| 4,146,154 | A | * | 3/1979 | Mastman | 222/109 |
| 4,986,453 | A | | 1/1991 | Lina et al. | |
| 5,181,635 | A | | 1/1993 | Balderrama | |
| 5,242,089 | A | | 9/1993 | Knickerbocker | |
| 5,360,127 | A | | 11/1994 | Barriac | |
| 5,445,299 | A | | 8/1995 | Harriman | |
| 5,544,789 | A | | 8/1996 | Gillingham | |
| 5,593,094 | A | | 1/1997 | Barriac | |
| 5,720,419 | A | | 2/1998 | Li | |
| 5,738,250 | A | | 4/1998 | Gillingham | |
| 5,785,208 | A | | 7/1998 | Dobbs et al. | |
| 6,045,008 | A | | 4/2000 | Gonzalez Fernandez et al. | |
| 6,158,625 | A | | 12/2000 | Siegel et al. | |
| 6,173,863 | B1 | | 1/2001 | Brozeil et al. | |
| 6,173,868 | B1 | | 1/2001 | DeJonge | |
| 6,223,951 | B1 | | 5/2001 | Siegel et al. | |

(Continued)

OTHER PUBLICATIONS http://www.saint-gobain-calmar.com/products.aspx?c=prod&sc=2&pid=20 (Calmar MD3200)—Oct. 19, 2006.

*Primary Examiner*—Kenneth Bomberg
(74) *Attorney, Agent, or Firm*—David Peterson

(57) ABSTRACT

Provided is a liquid dispensing package for a container adapted to contain a liquid that includes a hand operated pump assembly coupled to an actuator, a liquid distribution subsystem in fluid communication with a discharge tube from the pump assembly, wherein downward motion of the actuator, provided by a user, causes liquid to travel through the discharge tube to the actuator top surface, and a through-pump liquid drain-back subsystem that permits drain-back of liquid from the top surface of the actuator when the actuator is in a rest position.

8 Claims, 15 Drawing Sheets

U.S. PATENT DOCUMENTS

| | | | | |
|---|---|---|---|---|
| 6,257,451 | B1 | 7/2001 | Siegel et al. | |
| 6,269,976 | B1 | 8/2001 | DeJonge | |
| 6,338,422 | B1 | 1/2002 | DeJonge | |
| 6,474,508 | B1 | 11/2002 | Marsh | |
| 6,543,649 | B1 | 4/2003 | Danielo et al. | |
| 6,634,872 | B1 * | 10/2003 | Bougamont et al. | 222/321.9 |
| 6,695,171 | B2 | 2/2004 | Walters et al. | |
| 6,702,157 | B1 | 3/2004 | Dobbs | |
| 6,716,805 | B1 | 4/2004 | Sherry et al. | |
| 6,729,500 | B1 | 5/2004 | Dobbs et al. | |
| 6,779,693 | B2 | 8/2004 | Sweeton et al. | |
| 6,953,297 | B2 | 10/2005 | Dobbs | |
| 2001/0025863 | A1 | 10/2001 | Lorscheidt et al. | |
| 2003/0192913 | A1 | 10/2003 | Prueter | |
| 2005/0100391 | A1 | 5/2005 | Dobbs et al. | |
| 2005/0224515 | A1 | 10/2005 | Mon et al. | |
| 2008/0135581 | A1 | 6/2008 | Kennedy et al. | |
| 2008/0138143 | A1 | 6/2008 | O'Connell et al. | |
| 2008/0138144 | A1 | 6/2008 | Kennedy et al. | |
| 2008/0166174 | A1 | 7/2008 | Kennedy et al. | |
| 2008/0314925 | A1 | 12/2008 | Kennedy et al. | |

* cited by examiner

26

THROUGH-PUMP LIQUID DRAIN-BACK SYSTEM FOR A DISPENSING PACKAGE

BACKGROUND OF THE INVENTION

1. Field of the Invention

This invention relates to liquid pump dispensing package for use with substrates such as paper towels, wipes, woven or nonwoven dishcloths, and sponges. More specifically, the present invention relates to a dispensing package having a through-pump drain-back subsystem that drains liquid from a dispensing package actuator to a container holding the liquid.

2. Description of the Related Art

Consumers have traditionally applied cleaning and disinfecting compositions with a dispenser, sometimes called a dispensing package. For example, in a cleaning process, a consumer applied the composition from a trigger spray bottle dispenser by spraying the composition on a surface and wiping it with a paper towel. Alternatively, the composition in a pour or pump-out bottle dispenser was added to a sponge, actived with water, and wiped on and rinsed off the surface with the sponge. These procedures and cleaning systems are inefficient because the consumer must go through several cleaning steps.

As an alternative to spray, pump-out, and pour dispensed cleaning systems, wet disinfectant or cleaning wipes, such as described in U.S. Pat. No. 6,716,805 to Sherry et al., are becoming increasingly popular for their convenience in combining a nonwoven, disposable substrate with a disinfecting or cleaning composition. Soap-loaded disposable dish cloths, as described in U.S. Pat. No. 6,652,869 to Suazon et al., are also popular for their convenience. These products combine the cleaning composition and the cleaning substrate in one cleaning system so that the consumer can perform the cleaning task with one hand and with one product. However, these systems have some drawbacks such as requiring water activation of a dry substrate or requiring a sealed packaging for a wet substrate.

Current dispensing packages, however, are not adequate for one hand application of cleaning and disinfecting compositions to cleaning substrates such as paper towels. Dispensing packages such as trigger sprayers or pump dispensers generally require one hand to hold and activate the dispenser and one hand to hold the cleaning substrates. Existing pump-up dispensers that can be ergonomically operated with the same hand that holds the cleaning substrate have small actuators that require the hand and substrate to be contracted into a ball in order to activate the dispenser. To overcome the problem that existing pump-up dispensers having small actuators that require the hand and substrate to be contracted into a ball in order to activate the dispenser is address in co-owned patent application Ser. No. 11/609,740 now U.S. App. 2008/0138143; Ser. No. 11/609,749 now U.S. App. 2008/0138144, Ser. No. 11/609,761 now U.S. App. 2008/0135581, and Ser. No. 11/621,235 now U.S. App. 2008/0166174 each of which is incorporated by reference in their entirety. These co-owned patent applications describe dispensing package liquid distribution subsystems that distribute a liquid at the entire top surface area of a large, hand-sized actuator so that the hand and substrate need not be contracted into a ball in order to operated the dispensing package.

Further, while gravity-flow liquid drain-back features are very common for bottle/spout systems for laundry aisle products, existing pump-up dispensing packages do not provide a drain-back subsystem that returns excess dispensed cleaning compositions not absorbed by the cleaning substrate. Some pump mechanisms and dispensers specifically prevent liquid from draining back into the liquid container of the dispensing package or from being drawn back into the liquid distribution subsystem of the dispensing package. This may be important for disinfecting or registered cleaning compositions.

However, it would often be desirable with other compositions or liquids, to collect excess dispensed product, not fully absorbed by the substrate at the actuator top surface, and return it by gravity flow or other means through an orifice in the actuator top surface back to the composition product container of the dispensing package. Where product drain-back into the container would not compromise the integrity of the product, this excess liquid collection and return feature would aid in the use, appearance, and efficiency of the dispensing package and would help prevent product drooling. Preventing product drooling or pooling on a dispenser surface would be an aesthetic benefit to the consumer.

Embodiments of a gravity-flow liquid drain-back subsystem are disclosed in co-owned patent application Ser. No. 11/767,646 now U.S. App. 2008/0314925, which is incorporated by reference in its entirety. The gravity-flow liquid drain-back subsystem returns excess liquid not absorb by the substrate during actuation of a pump-up dispensing package to the container from which the liquid product is dispensed. A drain-back pathway, separate from the liquid distribution system pathway, is utilized to drain excess liquid back to the dispensing package container. It would be desirable to provide an excess liquid collection subsystem for a dispensing package, which avoids the separate return pathway of the gravity-flow liquid drain-back subsystem.

To overcome these problems of a gravity-flow liquid drain back system that utilizes a separate return pathway, co-owned patent application Ser. No. 11/769,610, which is incorporated by reference in its entirety, discloses a liquid draw-back subsystem that utilized suction to return excess liquid from the actuator top surface back into the liquid distribution subsystem upon each reciprocation of the dispensing package actuator. However, excess liquid draw-back subsystems utilizing suction require costly additional components over gravity-flow drain-back subsystems.

To overcome these problems, the dispensing package embodiments of the present invention are designed to provide a dispensing package that allows a consumer to conveniently apply a liquid cleaning composition from a container to a substrate with one hand and in a controlled manner. Further, the dispensing package embodiments of the present invention are designed to provide a dispensing package having an actuator with a gravity-flow drain-back subsystem that returns excess liquid cleaning composition not absorbed by the substrate to the container without the need for a liquid pathway separate from the liquid pathway used to apply the liquid cleaning composition to the substrate.

SUMMARY OF THE INVENTION

Embodiments of the present invention provide a liquid dispensing package that includes a container adapted to contain a liquid and an actuator having an actuator top with at least one discharge orifice therethrough. An actuator top surface of the actuator top, is in fluid communication with the container through the one or more discharge orifices to permit flow of liquid from the container to the actuator top surface upon reciprocation of the actuator. Further, the at least one discharge orifice allows excess liquid to gravity-flow back to the container after completion of use of the dispensing package by a consumer. The liquid pathway utilized to distribute the liquid in the container to the actuator top surface is the same liquid pathway utilized to gravity drain excess liquid on the actuator top surface back to the container.

In accordance with an object of the present invention and those that will be mentioned and will become apparent below, one aspect of the present invention is a dispensing package that includes a hand operated pump coupled to the actuator, a liquid distribution subsystem including a discharge tube from the pump, wherein depression of the actuator causes liquid to travel through the discharge tube to the actuator top surface. The liquid distribution subsystem delivers liquid to an area of the actuator top surface greater than the circumferential area of the discharge tube.

The liquid distribution subsystem of the dispensing package may include a manifold type distribution subsystem, a spray type distribution subsystem, or a surface distribution channel type distribution subsystem. Various liquid distribution pathways from the container to the actuator top surface are utilized.

Another aspect of the present invention is a dispensing package that includes a liquid drain-back subsystem that provides for liquid on the actuator top surface to flow back by gravity to the container after each reciprocation of the actuator and when the dispensing package is subsequently not in use and configured in an upright position.

The liquid drain-back subsystem of the dispensing package may include a below the pump piston head type drain-back subsystems or an above the pump piston head type drain-back subsystem. Various liquid drain-back pathways from the actuator top surface to the container are utilized. Each of the various liquid pathways used by the liquid drain-back subsystem are the same respective liquid pathways used by the liquid distribution subsystem.

DETAILED DESCRIPTION OF THE INVENTION

Figure 1:
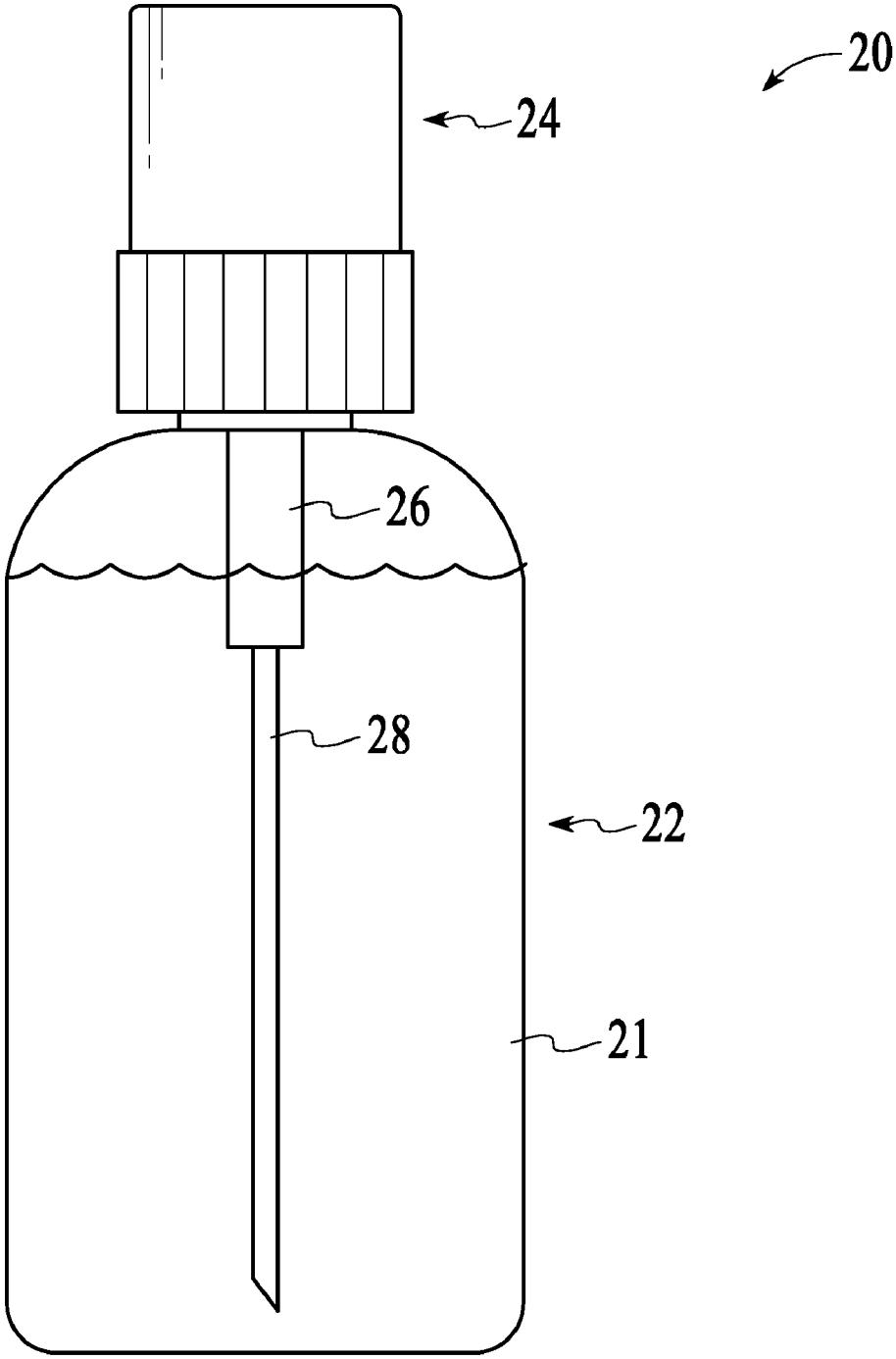
FIG. 1 is a front view of a first embodiment of a dispensing package of the present invention with the package shown assembled in a condition prior to use.

While this invention is susceptible of embodiment in many different forms, this specification and the accompanying drawings disclose only some specific forms as examples of the invention. The invention is not intended to be limited to the embodiments so described. It is also to be understood that the terminology used herein is for the purpose of describing particular embodiments of the invention only, and is not intended to limit the scope of the invention in any manner. The scope of the invention is pointed out in the appended claims.

For ease of description, the components of this invention and the container employed with the components of this invention are described in the normal (upright) operating position, and terms such as upper, lower, horizontal, etc., are used with reference to this position. It will be understood, however, that the components embodying this invention may be manufactured, stored, transported, used, and sold in an orientation other than the position described.

Figures illustrating the components of this invention and the container show some conventional mechanical elements that are known and that will be recognized by one skilled in the art. The detailed descriptions of such elements are not necessary to an understanding of the invention, and accordingly, are herein presented only to the degree necessary to facilitate an understanding of the novel features of the present invention.

All publications, patents and patent applications cited herein, whether supra or infra, are hereby incorporated by reference in their entirety to the same extent as if each individual publication, patent or patent application was specifically and individually indicated to be incorporated by reference.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

It must be noted that, as used in this specification and the appended claims, the singular forms "a," "an" and "the" include plural referents unless the content clearly dictates otherwise. Thus, for example, reference to a "surfactant" includes two or more such surfactants.

Unless defined otherwise, all technical and scientific terms used herein have the same meaning as commonly understood by one of ordinary skill in the art to which the invention pertains. Although a number of methods and materials similar or equivalent to those described herein can be used in the practice of the present invention, the preferred materials and methods are described herein.

In the application, effective amounts are generally those amounts listed as the ranges or levels of ingredients in the descriptions, which follow hereto. All percentages, ratios and proportions are by weight, and all temperatures are in degrees Celsius (° C.), unless otherwise specified. All measurements are in SI units, unless otherwise specified. Unless otherwise stated, amounts listed in percentage ("%'s") are in weight percent (based on 100% active) of the cleaning composition alone. It should be understood that every limit given throughout this specification will include every lower, or higher limit, as the case may be, as if such lower or higher limit was expressly written herein. Every range given throughout this specification will include every narrower range that falls within such broader range, as if such narrower ranges were all expressly written herein.

The term "surfactant", as used herein, is meant to mean and include a substance or compound that reduces surface tension when dissolved in water or water solutions, or that reduces interfacial tension between two liquids, or between a liquid and a solid. The term "surfactant" thus includes anionic, nonionic, cationic and/or amphoteric agents.

The composition can be used as a disinfectant, sanitizer, and/or sterilizer. As used herein, the term "disinfect" shall mean the elimination of many or all pathogenic microorganisms on surfaces with the exception of bacterial endospores. As used herein, the term "sanitize" shall mean the reduction of contaminants in the inanimate environment to levels considered safe according to public health ordinance, or that reduces the bacterial population by significant numbers where public health requirements have not been established. An at least 99% reduction in bacterial population within a 24 hour time period is deemed "significant." As used herein, the term "sterilize" shall mean the complete elimination or destruction of all forms of microbial life and which is authorized under the applicable regulatory laws to make legal claims as a "Sterilant" or to have sterilizing properties or qualities.

As used herein, the term "polymer" generally includes, but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the molecule. These configurations include, but are not limited to isotactic, syndiotactic and random symmetries.

The term "plastic" is defined herein as any polymeric material that is capable of being shaped or molded, with or without the application of heat. Usually plastics are a homo-polymer or co-polymer that of high molecular weight. Plastics fitting this definition include, but are not limited to, polyolefins, polyesters, nylon, vinyl, acrylic, polycarbonates, polystyrene, and polyurethane.

Dispensing Package

FIG. 1 illustrates a dispensing package 20 employing an actuator 24, a pump assembly 26, and a dip tube 28 installed on a container 22. In this embodiment, the container 22 is transparent and contains a cleaning composition liquid 21.

Figure 2:
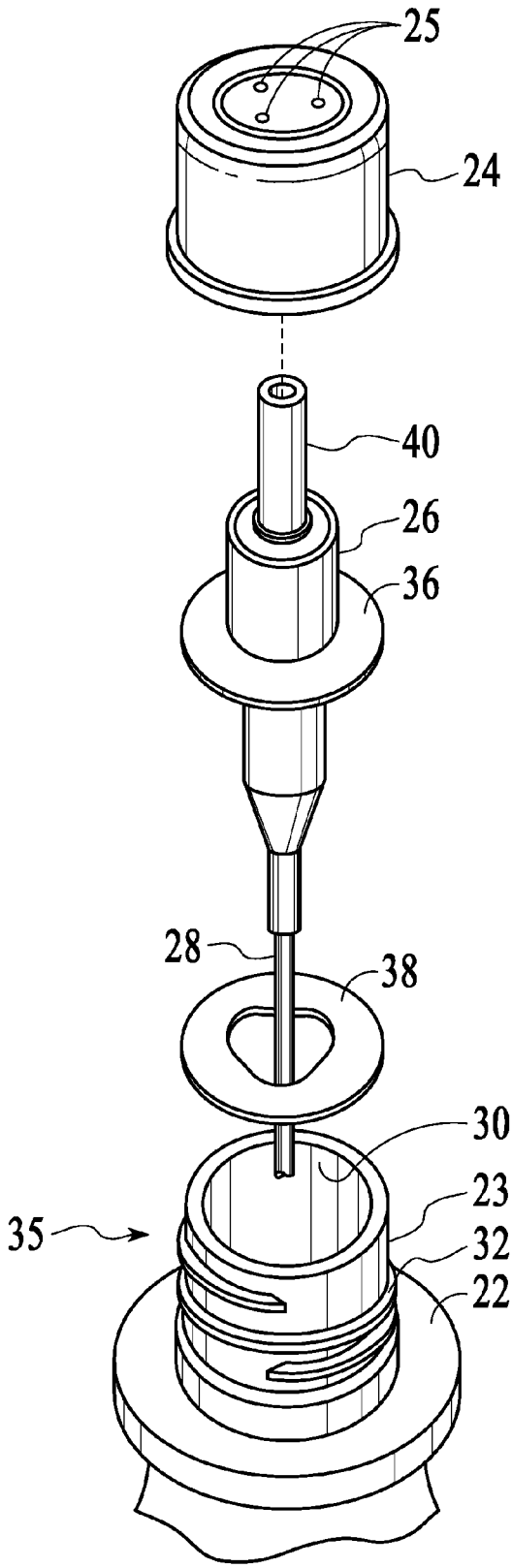
FIG. 2 is a fragmentary, exploded, perspective view of the package illustrated in FIG. 1.

FIG. 2 illustrates a typical pump assembly 26 that may be employed on the container 22 and which is adapted to be mounted in the neck 23 of the container 22. The exterior of the container neck 23 typically defines container threads 32 for engaging a closure 34 (FIG. 4A) as described hereinafter. The container threads 32 define a container connection feature 35 adjacent the container mouth 30. Other connection features may be employed in cooperation with mating or cooperating closure connection features 48 (FIG. 4A) on the closure 34. Other container and closure connection features could include a snap-fit bead and groove arrangement or other conventional or special connection features, including non-releasable connection features such as adhesive, thermal bonding, staking, etc. The dispensing package may be disposable and designed for one use and not designed to be refillable. In the embodiment of FIG. 1 for example, the actuator 24 and/or pump assembly 26 may be fused to the container 22, for example with spot welding.

A part of the pump assembly 26 may extend into the container opening or mouth 30. The bottom end of the pump assembly 26 is attached to a conventional dip tube 28, and the upper end of the pump assembly projects above the container neck 23. The pump assembly 26 includes an outwardly projecting flange 36 for supporting the pump assembly 26 on the container neck 23 over a conventional sealing gasket 38 which is typically employed between the pump assembly flange 36 and container neck 23. Other sealing designs such as plug seals can be used in place of a gasket. The hollow tubular stem or cylindrical discharge tube 40 establishes communication between a pump chamber 33 (FIG. 5A) within the pump assembly 26 and an actuator 24 which is mounted to the upper end of the discharge tube 40.

The actuator 24 has a hand-and-substrate engageable region and can be depressed by the user's hand containing a substrate, such as a sponge, to move the discharge tube downwardly in the pump assembly 26 to dispense liquid from the pump assembly 26. The liquid is pressurized in the pump assembly chamber 33 (FIG. 5A) and exits from the actuator discharge orifices 25 (FIG. 2) in the actuator 24.

It will be appreciated that the particular design of the pump assembly 26 may be of any suitable design for pumping a product from the container 22 (with or without a dip tube 28) and out through the discharge tube 40. The detailed design and construction of the pump assembly 26 per se forms no part of the present invention except to the extent that the pump assembly 26 is adapted to be suitably coupled and held on the container 22 with a suitable mounting system.

While, with certain modifications described in detail below with reference to FIGS. 5A-5D, the present invention may be practiced with liquid pumps of many different designs, the internal design configuration of one suitable pump is generally disclosed in U.S. Pat. No. 4,986,453, the disclosure of which is hereby incorporated herein by reference thereto. It should be understood, however, that the present invention is suitable for use with a variety of hand-operable.

Container

Figure 3:
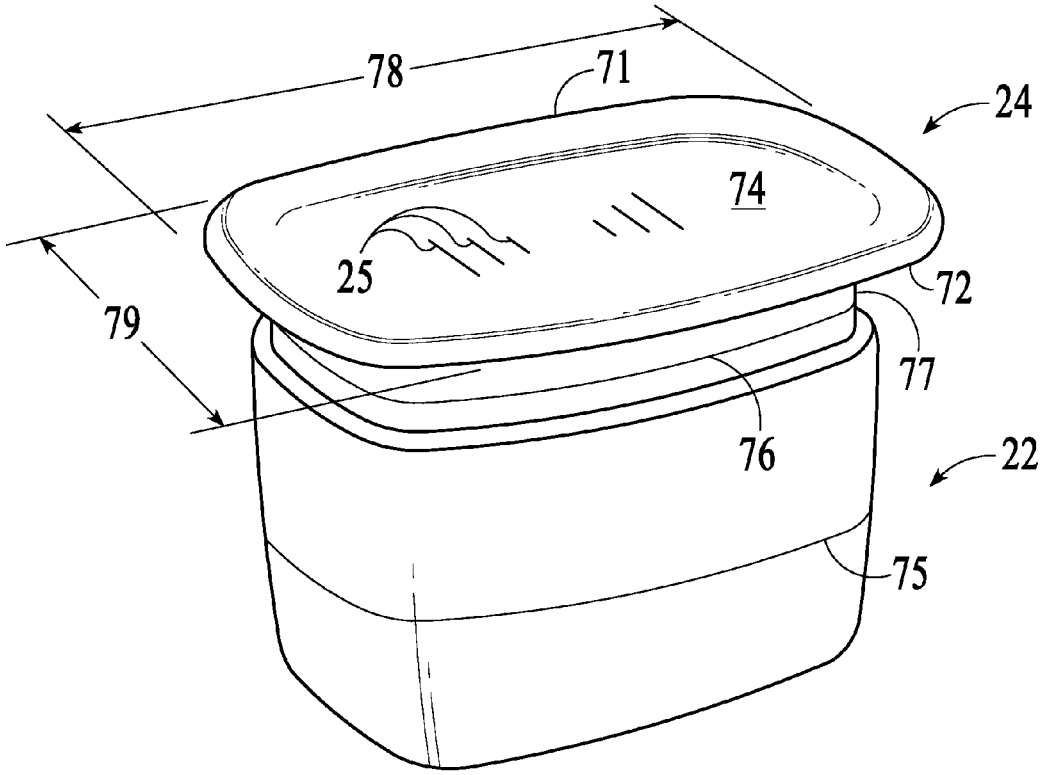
FIG. 3 is a perspective view of another embodiment of a dispensing package of the present invention with the package shown assembled in a condition prior to use.
Figure 4A:
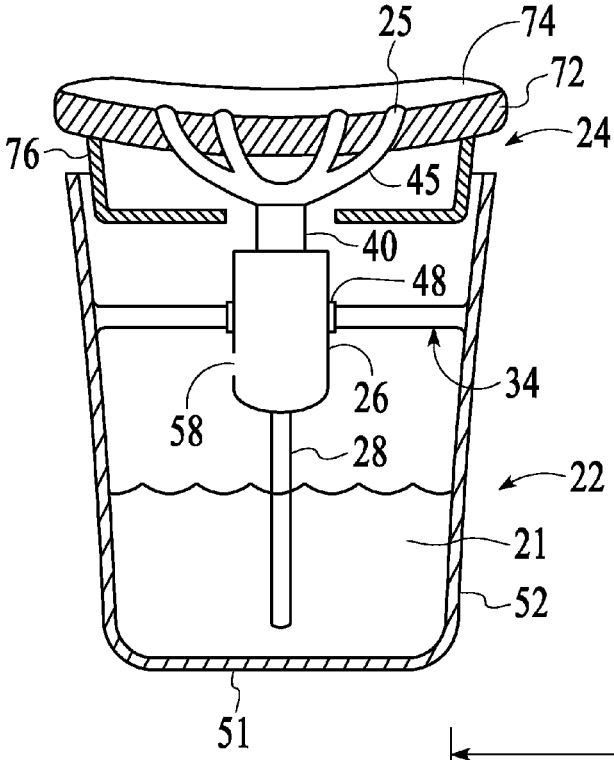
FIG. 4A shows a side cross-sectional view of another embodiment of a dispensing package of the present invention having a liquid distribution subsystem and a through-pump liquid drain-back subsystem.

FIG. 3 is a perspective view of another embodiment of a dispensing package of the present invention with the package shown assembled in a condition prior to use. FIG. 4A shows a side cross-sectional view of another embodiment of a dispensing package of the present invention having a liquid distribution subsystem and a through-pump liquid drain-back subsystem. Referring to FIGS. 3 and 4A together, embodiments of the dispensing package 20 can comprise a container 22 adapted to contain a liquid 21 the container 22 having a container bottom 51; a container sleeve 52 coupled to the container bottom 51 and depending upwardly from the peripheral edge of the container bottom 51; an actuator 24 having an actuator top 72 with an actuator top surface 74 and an actuator skirt 76 coupled to the actuator top 72 and depending downwardly from the peripheral edge of the actuator top 72; wherein a sleeve interior surface of the container sleeve 52 is slideably engagable with a skirt exterior surface 77 of the actuator skirt 76; a pump assembly 26 having a hollow discharge tube 40, the pump assembly 26 being disposed within the container 22 and in fluid communication with the actuator 24; wherein the actuator 24 has at least one discharge orifice 25 in fluid communication with the container 22 through the discharge tube 40 of the pump assembly 26 to permit liquid to flow onto the actuator top surface 74 of the actuator top 72 upon reciprocation of the actuator top 72; and wherein the at least one discharge orifice 25 orifice permits excess liquid to gravity-flow back through the pump assembly 26 to the container 22 after completion of use of the dispensing package 20 by a consumer and when the dispensing package is placed in an upright position.

The container 22 can have a variety of shapes. The container can be round or oval or rectangular with rounded corners as shown in FIG. 3. The container dimensions can be measured from a horizontal slice 75 of the container 22. The container can be made from plastic materials. The container, and other components of the dispensing package, can be constructed of any of the conventional material employed in fabricating containers, including, but not limited to: polyethylene; polypropylene; polyacetal; polycarbonate; polyethyleneterephthalate; polyvinyl chloride; polystyrene; blends of polyethylene, vinyl acetate, and rubber elastomer. Other materials can include stainless steel and glass. A suitable container is made of clear material, e.g., polyethylene terephthalate.

Actuator

The ergonomic shape of the actuator 24 makes the actuator easy to reciprocate with a substrate such as paper towel or sponge, and to operate using one hand. One measure of the actuator shape is a vertical projection 71 (FIG. 3) of the actuator top surface 74 of the actuator top 72, where a vertical projection is a projection onto the horizontal plane. The vertical projection 71 has a length 78 and a width 79. The aspect ratio is the ratio of the length to the width. For a circle, the aspect ratio would be 1. Unless the hand or the substrate in the hand is severely compressed, then both the hand and substrate would have an aspect ratio greater than 1. In order to ergonomically apply the composition to the substrate in the hand, in some embodiments of the invention it would be desirable for the actuator and or the pattern of orifices to have an aspect ratio greater than 1. The vertical projection of the actuator top can have an aspect ratio of greater than 1, or greater than 1.1, or greater than 1.2, or greater than 1.5, or at least 1.1, or at least 1.2, or at least 1.5, or less than 2, or less than 1.5. In order to provide a large surface for one-handed use of the dispensing package, in some embodiments, the actuator top size can be approximately the same size or larger than the container. The actuator top size can be larger than the width of two fingers for easy ergonomic use with a cleaning substrate. The vertical projection of the actuator top length can be larger than about 1.5 inches, or from 2 to 10 inches, or from 2 to 8 inches, or from 2 to 5 inches, or from 2 to 3 inches, or from 2.5 to 8 inches, or from 2.5 to 5 inches, or from 2.5 to 3 inches. The vertical projection of the actuator top can have an area of greater than 2 square inches, greater than 5 square inches, greater than 6 square inches, greater than 7 square inches, greater than 8 square inches, greater than 10 square inches, less than 8 square inches, less than 10 square inches, or less than 20 square inches. For use with a semi-rigid rectangular substrate, for example a sponge, the actuator top can be approximately the same size or somewhat smaller than a standard rectangular sponge, for example about 2.5 by about 4.5 inches. The vertical projection of the top surface of the actuator top can have at least one dimension that is greater than the corresponding dimension of any horizontal slice 75 of the container (FIG. 3).

The actuator top 72 can have a concave shape that is round, oval, a rectangular with rounded corners as shown in (FIG. 3), elliptical, or other shape that fits the hand, a sponge, or other substrate. The concave shape allows the capture of excess composition without dripping. The actuator can have a rim to prevent spillage. In certain embodiments, it may be useful for the actuator to be substantially flat or convex for ergonomic effectiveness with certain substrates.

Figure 7:
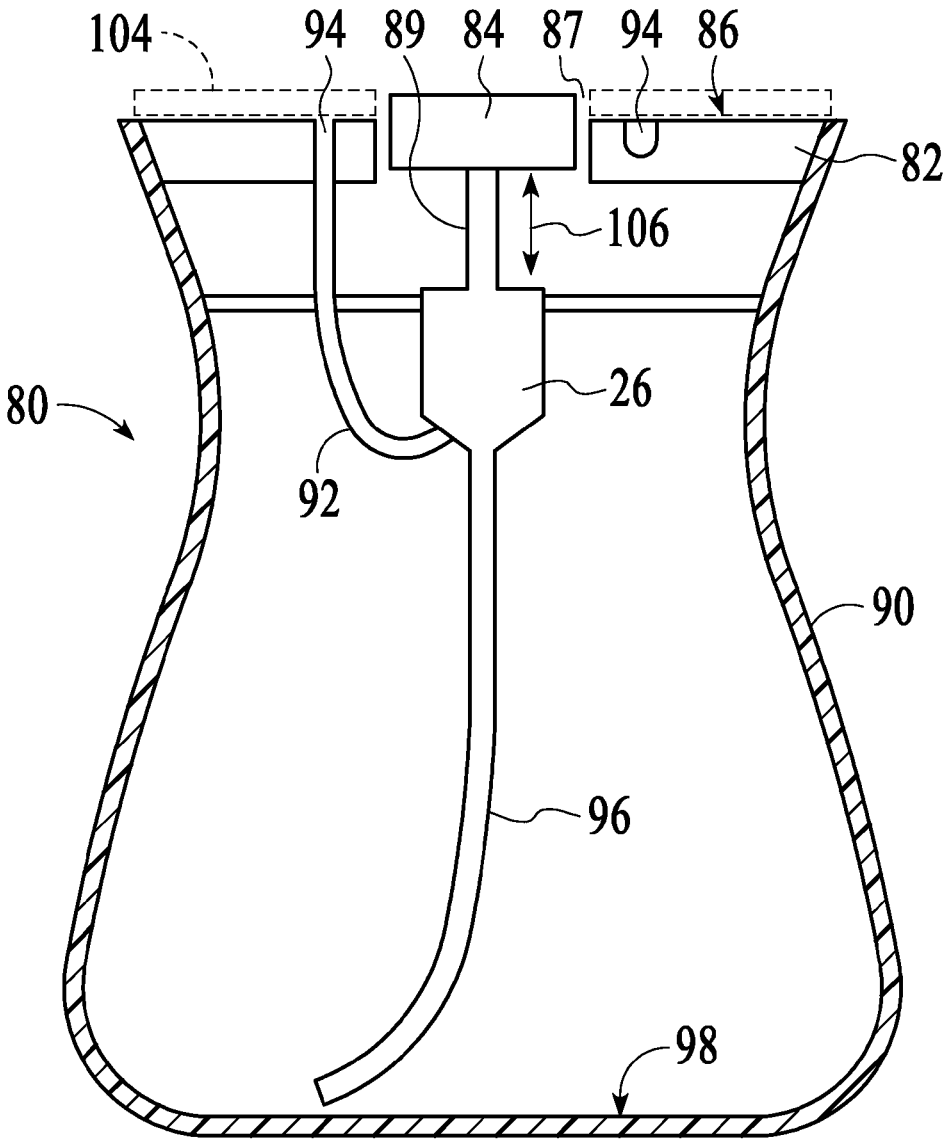
FIG. 7 shows a side cross-sectional view of another embodiment of a dispensing package of the present invention having a liquid distribution subsystem and a through-pump liquid drain-back subsystem.

The actuator can individually be adapted to the respective requirements with regard to the direction of the discharge orifice as well as with regard to the use of opening valves. The actuator is not limited to having a discharge orifice 25 which moves together with the actuator, but it may also comprise an actuator of the type having a stationary discharge orifice 94, as shown in FIG. 7. The actuator may have a surface that slideably engages the container and is internal or external to the container Actuator Discharge Orifices As noted above, the dispensing package can have one or more openings or discharge orifices 25 situated on the actuator 24 (for example FIGS. 2, 3 and 4A). The discharge orifices 25 can be a small or large, round, slit or other suitable shape. The discharge orifice or orifices 25 can be centered in the actuator. Because the actuator is enlarged, the discharge orifices or orifices can be located away from the edge of the actuator to prevent, for example, spilling the composition. The actuator top can have multiple discharge orifices and the discharge orifices can be indented from the exterior edge of the top surface of the actuator top. The actuator top can have multiple discharge orifices wherein the pattern of discharge orifices has an aspect ratio of at least 1.5, or greater than 1, or greater than 1.1, or greater than 1.2, or greater than 1.5, or at least 1.1, or at least 1.2, or less than 2, or less than 1.5. Where the pattern of discharge orifices has an aspect ratio of at least 1.5, then the composition can be applied to the substrate in an area having an aspect ratio of at least 1.5, or greater than 1, or greater than 1.1, or greater than 1.2, or greater than 1.5, or at least 1.1, or at least 1.2, or less than 2, or less than 1.5. When for example the actuator top is large and has multiple discharge orifices, the actuator can apply at least 0.3 ml of the composition (or other volume) to the substrate in an area of greater than 2 square inches and less than 20 square inches, or an area of greater than 4 square inches, greater than 5 square inches, greater than 6 square inches, greater than 7 square inches, greater than 8 square inches, greater than 10 square inches, less than 8 square inches, less than 10 square inches, or less than 20 square inches.

Pump Assembly

Figure 5A:
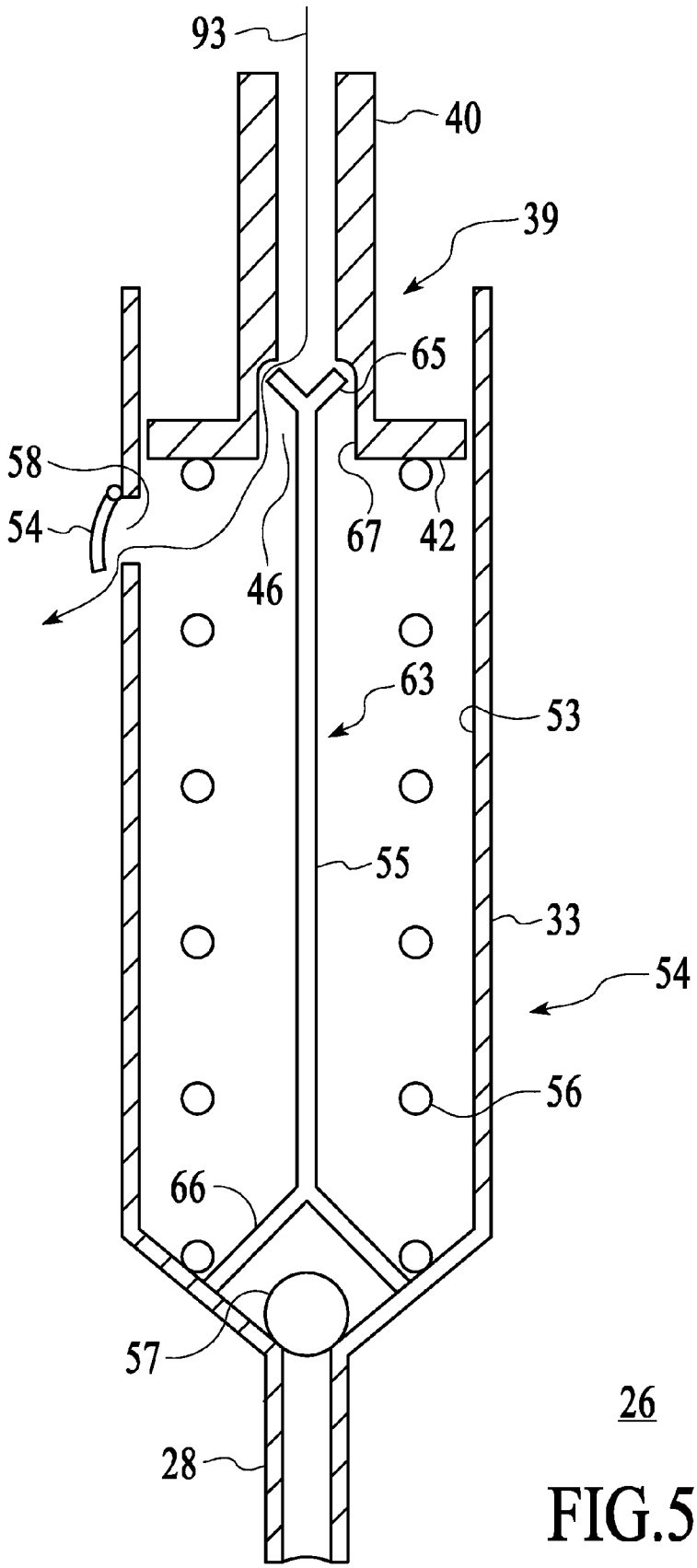
FIG. 5A shows a schematic side cross-sectional view of a pump assembly for the dispensing package of FIG. 4A in a rest position.

FIG. 5A shows a schematic side cross-sectional view of a pump assembly 26 for the dispensing package of FIG. 4A in a rest position before operation of dispensing package. Referring to FIGS. 4A and 5A together, pump assembly 26 provides both liquid pressure to move liquid 21 from the container 22 to the actuator 24 and allows excess liquid not absorbed by a substrate to gravity drain from the actuator 24 through the pump assembly 26 to the container 22. The pump assembly 26 includes the pump chamber 33 configured as a cylinder. A pump piston 39, which includes a piston head 42 configured as a disk-like plate having a piston opening 46 therethrough, fits within the pump chamber 33. The peripheral edge of the piston head 42 form a substantially liquid tight seal with the pump chamber sidewall 53. Fluidly coupled with the piston opening 46, is a hollow tubular stem or cylindrical discharge tube 40, as described, for example, with reference to the embodiments of the dispensing package shown in FIGS. 1, 4A, 6, and 7. As described above for these dispensing packages, the actuator 24 is coupled to discharge tube 40 such that reciprocation of the actuator 24 permits liquid to flow through the discharge tube 40 of the pump assembly 26 onto an actuator top surface 74 of the actuator top 72.

Figure 5B:
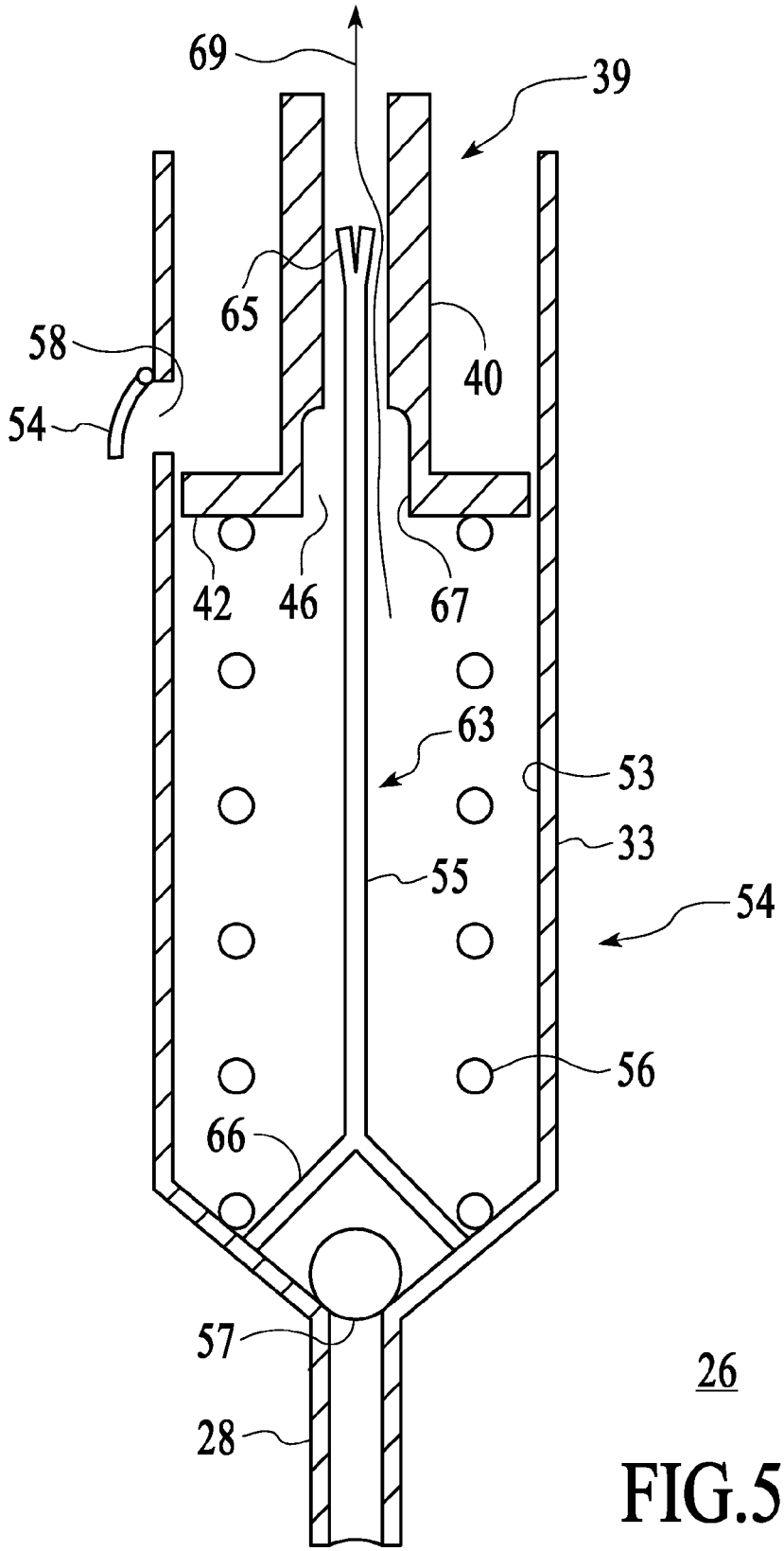
FIG. 5B shows a schematic side cross-sectional view of a pump assembly for the dispensing package of FIG. 4A during travel to a compressed position after application of downward force on an actuator of the dispensing package of FIG. 4A.

A coil spring 56, or other suitable resilient member, maintains the pump piston 39 and thus the actuator 24 to which it is coupled, in an upward or rest position. As shown in FIG. 5B, coil spring 56 is compressed upon application of a downwardly directed force on the actuator 24 by a user of the dispensing package. The compressed coil spring 56, provides an upward biasing force that tends to return the actuator 24 to its original rest position when the actuator is released by the user. A check ball 57, or other suitable check valve, where the dip tube 28 enters the pump chamber 33, prevents back flow of liquid in pump chamber 33 through the dip tube 28 to the container 22 when the pump piston 39 is in the upward rest position shown in FIG. 5A.

The pump chamber sidewall 53 of the pump chamber 33 includes a pump chamber sidewall opening 58 therethrough. The pump chamber sidewall opening 58 is situated below closure 34 as shown in FIG. 4A. Thus, pump chamber 33 is placed in fluid communication, through the pump chamber sidewall opening 58, with the space in the container 22 below the closure 34. Further, when, the pump piston 39 is in its rest position as shown in FIG. 5A, the biasing force of coil spring 56 is selected such that pump chamber sidewall opening 58 is situated just below the piston head 42 of pump piston 39. Thus, with actuator 24 in a rest position, liquid within pump chamber 33 that is above the pump chamber sidewall opening 58 may gravity flow from the pump chamber 33 to the container 22. The pump chamber sidewall opening 58 may include a pump chamber sidewall opening check value 54, such as a one-way flapper value, well known in the art, to prevent liquid flow from the container 22 if the container 22 is not upright.

Further, the pump assembly 26 includes a special pump outlet valve 63. As described in detail below with reference to FIG. 5B-5C, special pump outlet valve 63 is a conventional pump outlet valve for a piston pump, well known in the art, with certain modifications. A typical pump outlet valve prevents flow or suction of liquid dispensed through discharge tube 40 from flowing back into pump chamber 33 through piston opening 46. A typical pump outlet valve prevents such back flow regardless of the position of the pump piston 39 within the pump chamber 33. However, the special pump outlet valve 63 is designed to provide no liquid seal against back flow of liquid from the discharge tube 40 when the pump piston 39, and thus the actuator 24 (FIG. 4A) to which it is attached, is in its upward or rest position shown in FIG. 5A.

In one embodiment, the special pump outlet valve 63, includes an "umbrella" valve component, well know in the art, supported on a valve stem 55. Special pump outlet valve 63, like a typical umbrella valve, includes a sealing plug 65 that is supported by and biases outwardly from the valve stem 55. In one embodiment, sealing plug 65 is configured as an inverted cone of resilient material. Valve stem 55 is in turn supported at the base of the pump chamber 33 by a valve support 66. Valve support 66 may also function as containment for check ball 57. In a typical umbrella valve, regardless of the position of pump piston 39 within the pump chamber 33, the conical sealing plug of the valve biases outwardly sufficiently far to contact and form a liquid seal with the inside cylindrical wall of the discharge tube 40.

However, as noted above, with special pump outlet valve 63, when pump piston 39 is in its rest position as shown, no liquid seal is formed to prevent back flow of liquid from the discharge tube 40 to the pump chamber 33 space below the piston head 42. An increase in the diameter of the discharge tube 40 where it couples with the piston head 42, defines a discharge tube cavity 67. The sealing plug 65 is designed such that it does not bias outwardly sufficient far to contact the sidewall of the discharge tube cavity 67. The discharge tube cavity 67 provides a passageway for excess liquid on the actuator top surface 74 to flow through the discharge orifices 25, through the liquid distribution system, into the discharge tube 40, to drain-back to pump chamber 33 when pump piston 39 is in its rest position. Thus, with the pump piston 39, and the actuator 24 to which it is coupled, is in a rest position, liquid in discharge tube 40 may flow by gravity from discharge tube 40 into the pump chamber 33 and out through pump chamber sidewall opening 58 into container 22, as indicated by arrow 93. Since the pump chamber sidewall opening 58, through which liquid flows to container 22, is below the rest position of pump piston head 42, liquid drain-back subsystems utilizing the pump assembly of FIG. 5A are classified as below the pump piston head type liquid drain-back subsystems.

FIG. 5B shows a schematic side cross-sectional view of a pump assembly for the dispensing package of FIG. 4A while traveling to a compressed position after application of downward force on the actuator 24 of the dispensing package of FIG. 4A. Referring to FIGS. 5B and 4A together, when a user of the dispensing package of the present invention applies a downwardly direct force on the actuator 24, pump piston 39, coupled to actuator 24 through discharge tube 40, similarly moves downward within the pump chamber 33 to a position below the rest position of the pump piston 39 thereby pressurizing the pump chamber 33 and discharge tube 40 to allow liquid to flow out of the pump assembly 26 through discharge tube 40. The check ball 57 prevents flow of pressurized liquid back through the dip tube 28 to the container 22. Further, the sealing plug 65, now within the interior of the discharge tube 40, has partially collapsed against its outward bias due to the pressurization thus providing a liquid pathway for the pressurized liquid within the pump chamber 33 to flow through the discharge tube 40 to the actuator 24 of the dispensing package, as indicated by arrow 69.

Figure 5C:
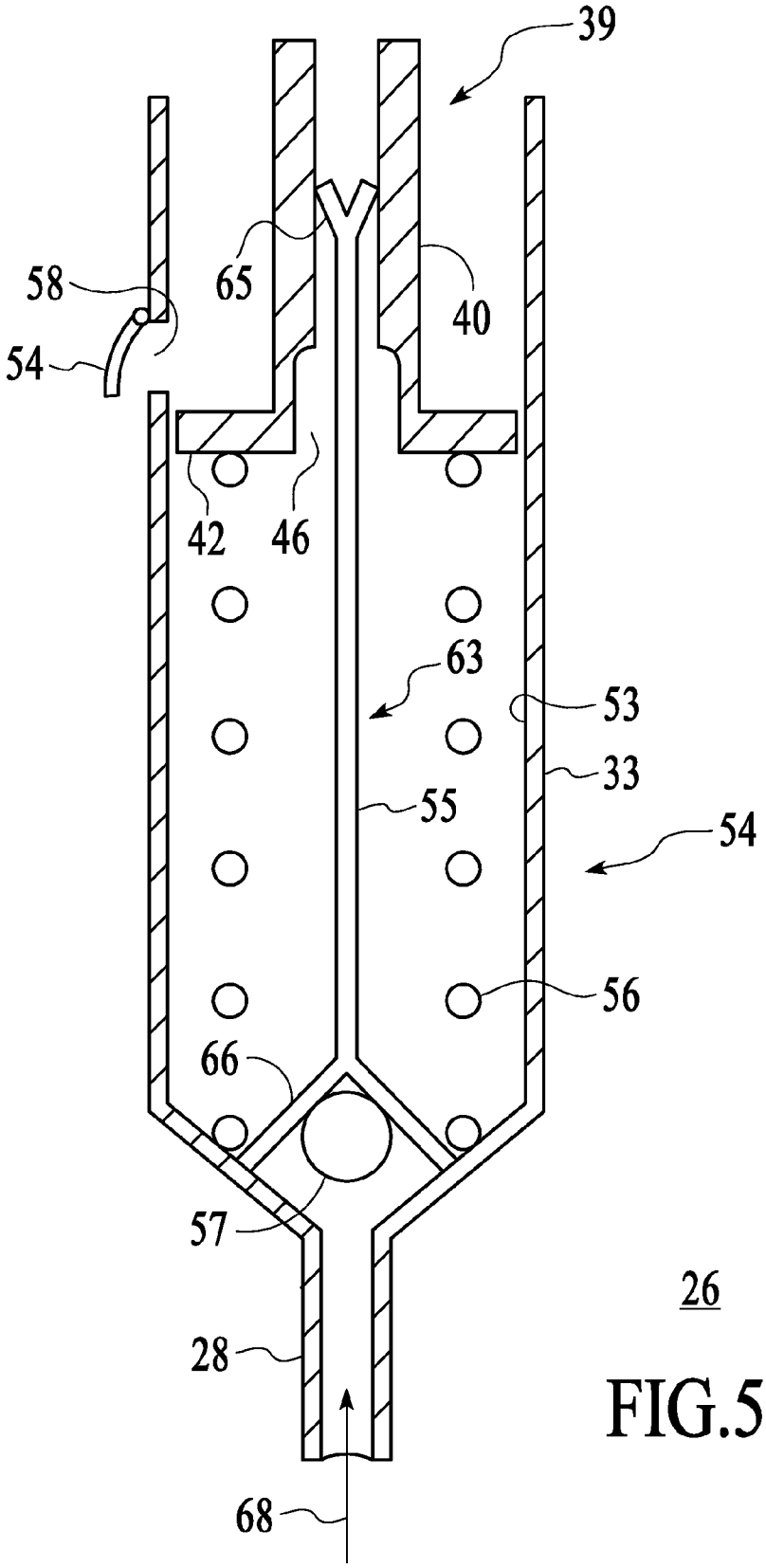
FIG. 5C shows a schematic side cross-sectional view of a pump assembly for the dispensing package of FIG. 4A in a compressed position after release of a downward force on an actuator of the dispensing package of FIG. 4A.

FIG. 5C shows a schematic side cross-sectional view of a pump assembly for the dispensing package of FIG. 4A in a compressed position but after release of the downward force on the actuator 24 of the dispensing package of FIG. 4A. Referring to FIGS. 5C and 4A together, when the actuator 24 is released for the downwardly directed force supplied by a user, the coil spring 56, compressed by the previously applied downward force, provides an upward biasing force that tends to return the pump piston 39 to its original rest position shown in FIG. 5A. As the pump piston 39 moves in an upward direction under the biasing force of the compressed coil spring 56, suction is created in the pump chamber 33. The check ball 57 rises as shown, thereby creating a pathway for liquid in container 22 to flow through the dip tube 28 and into the expanding volume between the pump piston 39 and the pump chamber 33. as indicated by arrow 68. Further, the sealing plug 65 still within the interior of the discharge tube 40 but released from pressurization, expands due to its outward bias to contact the interior sidewall of the discharge tube 40 to form a liquid tight seal against suction back flow of liquid within the discharge tube 40 to the pump chamber 33.

Figure 5D:
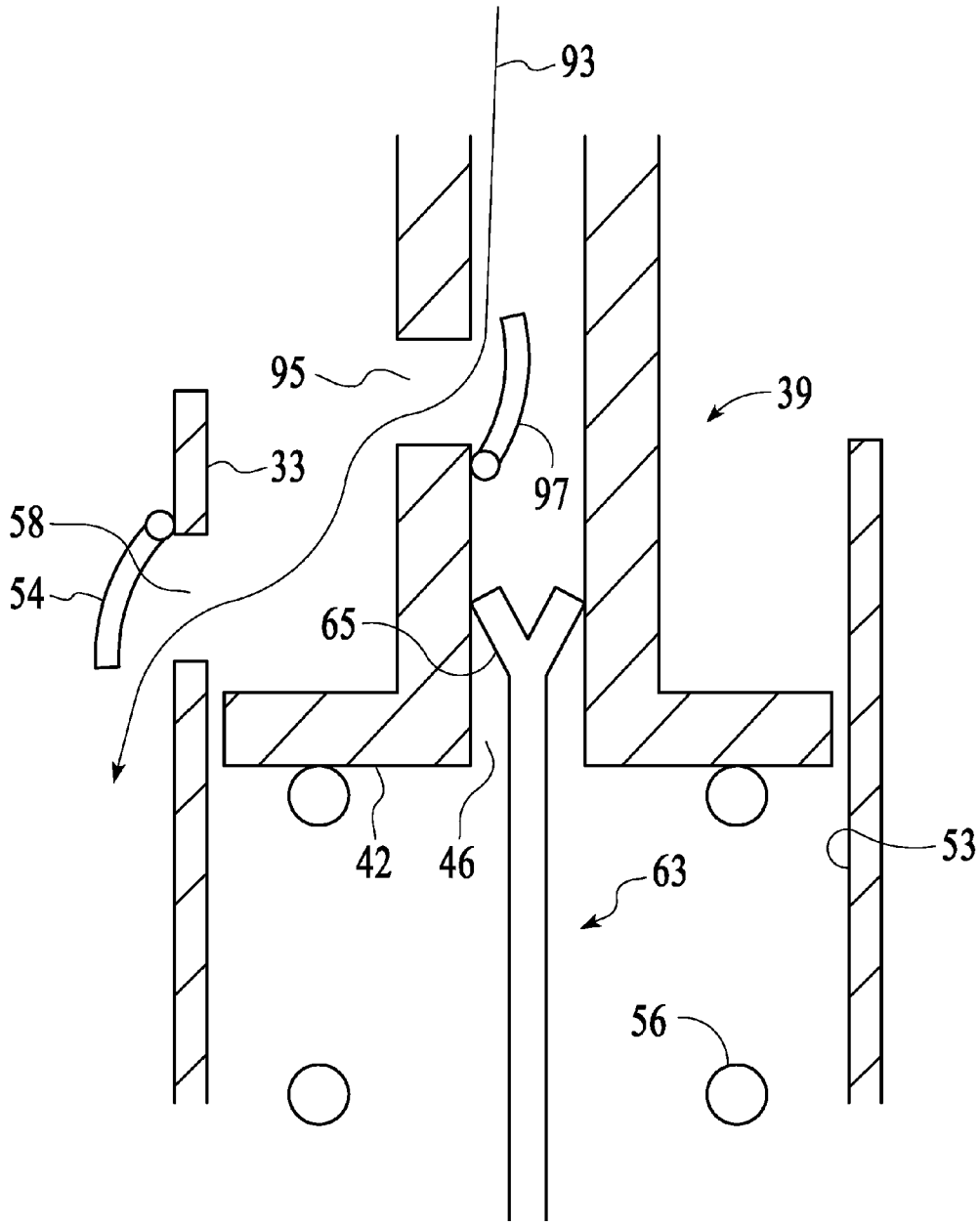
FIG. 5D shows a schematic, side cross-sectional, detail view of the outlet valve of another pump assembly for the dispensing package of FIG. 4A.

FIG. 5D shows a schematic, side cross-sectional, detail view of a pump outlet valve of another pump assembly for use with the dispensing package of FIG. 4A. In the figure, pump piston 39 is shown in its upward or rest position. In this embodiment, pump outlet valve 63 is a conventional pump outlet valve. Accordingly, as described above, pump outlet valve 63 prevents flow or suction of liquid dispensed through the discharge tube 40 from flowing back into pump chamber 33 through the piston head opening 46 at all positions of the pump piston 39, including the rest position shown in the figure. Further, discharge tube 40 where it couples with the piston head 42 does not expand to define a discharge tube cavity 67 as in the embodiment of FIG. 5A. Sealing plug 65 biases outwardly sufficiently far to contact the interior sidewall of the discharge tube 40 to provide a liquid tight seal. Unlike the embodiment of FIG. 5A, no passageway from the discharge tube 40 and past the sealing plug 65 is provided when the pump piston 39 is in the rest position.

However, the discharge tube 40 includes a discharge tube sidewall opening 95 therethrough. The discharge tube sidewall opening 95 places the interior of the discharge tube 40 in fluid communication with the space of pump chamber 33 above the piston head 42. The discharge tube sidewall opening 95 provides a passageway for liquid in discharge tube 40 to drain-back to pump chamber 33 when pump piston 39 is in its rest position. The discharge tube sidewall opening 95 includes a normally open discharge tube sidewall opening check valve 97. Discharge tube sidewall opening check valve 97 maybe a flapper valve as show. However, discharge tube sidewall opening check valve 97 is a check valve which has a slight bias to stay open during low pressure gravity flow of liquid from the discharge tube 40, but which closes upon pressurization of discharge tube 40 when the pump assembly 26 produces pressure within the pump chamber 33. In this manner liquid may flow by gravity through discharge tube sidewall opening 95 but may not flow when discharge tube is pressurized during pumping.

The pump chamber sidewall 53 of the pump chamber 33 includes a pump chamber sidewall opening 58 therethrough. If the pump chamber sidewall opening 58 is situated just above the pump piston 39 when in its rest position as shown in FIG. 5D, liquid within pump chamber 33 that is above the pump chamber sidewall opening 58 may gravity flow from the pump chamber 33 to the container 22. The pump chamber sidewall opening 58 may include a pump chamber sidewall opening check valve 54, such as a one-way flapper value, well known in the art, to prevent liquid flow from the container 22 if the container 22 is not upright.

Thus, with the pump piston 39, and the actuator 24 (FIG. 4A) to which it is coupled, is in a rest position, liquid, including excess liquid, may gravity flow drain-back through the distribution orifices 25, through one of the various liquid distribution pathways described below, into the discharge tube 40 into the pump chamber 33 and out through the pump chamber sidewall opening 58 into container 22 (FIG. 4), as indicated by arrow 93. Since the pump chamber sidewall opening 58, through which liquid flows to container 22, is above the rest position of pump piston head 42, liquid drain-back subsystems utilizing the pump assembly of FIG. 5D is classified as above the pump piston head type drain-back subsystems.

Liquid Distribution Subsystem and Liquid Drain-Back Subsystem

As noted above, the actuator 24 defines a discharge passage through which the product from the stem or discharge tube 40 is discharged. The actuator 24 has a hand-and-substrate engageable region and can be depressed by the user's hand containing a substrate, such as a sponge, to move the discharge tube 40 downwardly in the pump assembly 26 to dispense liquid from the pump assembly 26. The liquid is pressurized in the pump chamber 33, flows through the discharge tube 40 and exits from the actuator discharge orifices 25 (FIG. 2) in the actuator 24.

When the actuator discharge covers a large area, it may be desirable to have a liquid distribution subsystem to deliver the liquid from the hollow discharge tube 40 delivered from container 22 by the pump assembly 26 to the discharge orifices 25. As described in more detail below with reference to FIG. 4A through FIG. 12B, the liquid distribution subsystems of the present invention may include, for example, a manifold type distribution subsystem, a spray type distribution subsystem, or a surface distribution channel type distribution subsystem. Irrespective of the particular foregoing subsystem, the liquid distribution subsystem of the present invention may deliver liquid to an area of the top surface of an actuator top greater than the circumferential or cross-sectional area of the discharge tube 40. As used herein, the term "liquid distribution subsystem" refers to a system for dispensing a liquid delivered to the system (such as by pump assembly 26) to a desired location (such as the top surface 74 of an actuator top 72).

Further, it may also be desirable to provide a through-pump liquid drain-back subsystem to return excess liquid not absorbed on a substrate back to the container 22. As, also described in more detail below with reference to FIG. 4A through FIG. 12B, the through-pump liquid drain-back subsystems of the present invention may include, for example, a below the pump piston head type through-pump liquid drain-back subsystems or an above the pump piston head type through-pump liquid drain-back subsystem. The through-pump liquid drain-back subsystem of the dispensing package of the present invention, utilizes the same liquid pathway to drain liquid from the actuator top surface 74 that is used to supply liquid from the container to the actuator 24 thus eliminating the need for a separate liquid drain-back pathway.

In one embodiment, the through-pump liquid drain-back subsystem utilizes the distribution orifices 25 used on the actuator top surface 74 in fluid communication via a pathway with the container 22, when the container 22 is at rest and in an upright configuration. In some embodiments, with the actuator 24 in a rest position, a pump chamber sidewall opening 58 of a pump chamber 33 is below a piston head 42 of a pump piston 39 (FIG. 5A) and in other embodiments, the pump chamber sidewall opening 58 is above the piston head 42 of the pump piston 39 (FIG. 5D). When the actuator 24 is upright and in a rest position, liquid, for example excess liquid not absorbed on a substrate, may gravity flow from the actuator 24 along the pathway of the liquid distribution system to the pump chamber 33 and then to the container 22. As used herein, the term "gravity-flow liquid drain-back" refers to a system for returning liquid previously delivered to a desired location, such as by pump assembly 26 to actuator top surface 74, to another desired location such as the container 22 along a pathway following a continuous downhill gradient. The pump chamber sidewall opening 58 may include a pump chamber sidewall opening check valve 54, such as a one-way flapper value, well known in the art, to prevent liquid flow from the container 22 if the container 22 is not upright.

After the actuator 24 is released by the user when the resiliently compressed pump coil spring 56 biases pump piston 39 upwardly thereby drawing liquid 21 from the container 22 (FIGS. 4A and 5A) through the dip tube 28 and into the pump chamber 33, the pump piston 39 of pump assembly 26 returns to a rest position as described above and provides for return of any excess liquid on the actuator top surface 74 of the actuator top 72 into the distribution orifices 25, discharge tube 40, and the pump assembly 26. Thus, a complete reciprocation cycle of actuator 24 is complete. Additional, reciprocations of the actuator 24 repeat the cycle.

Operation of the Dispensing Package

More particularly, FIG. 4A shows a cross-sectional view of an embodiment of a dispensing package 20 having a liquid distribution subsystem and a through-pump liquid drain-back subsystem. Dispensing package 20 includes a manifold type distribution subsystem having discharge channels 45, fluidly coupled via discharge tube 40 to the pump assembly 26 installed on a container 22 by a closure 34 on the container 22. The closure 34 isolates stored liquid 21 in the container 22 to a space below the closure 34, allowing liquid to exit the container 22 only via pump assembly 26 and, more specifically, through discharge tube 40 and discharge channels 45. In the embodiment shown, the closure 34 is a dome or disk-like structure coupled to the perimeter sidewall of container 22 and coupled to pump assembly 26 by a liquid tight closure connection feature 48, such as a threaded coupling, that cooperates with a container connection feature 35 (FIG. 2) on the container 22. In one embodiment, either a rigid cartridge or flexible pouch is inserted into a rigid container with some fitment mechanism to attach the pump assembly 26 and actuator 24.

Figure 4B:
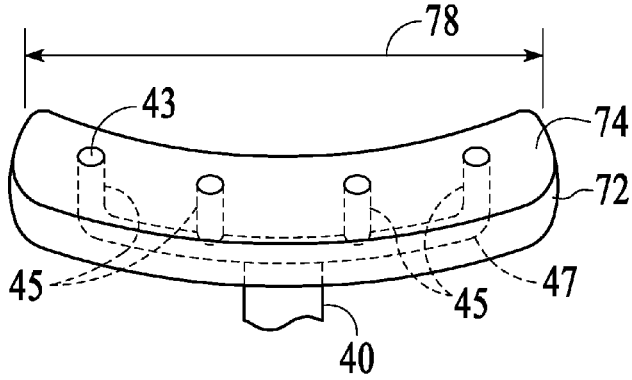
FIG. 4B shows a side view of another embodiment of a liquid distribution subsystem for use with the dispensing package of the present invention.

Pump assembly 26 includes a hollow dip tube 28 adapted to transport a liquid. An actuator 24, coupled to the liquid transport assembly 26, may be manually reciprocated by a user of dispensing package 20 to move liquid 21 contained in container 22 through the dip tube 28 and the discharge channels 45 to the an actuator top 72 of the actuator 24 having an actuator top surface 74 with discharge orifices 25 that terminate the discharge channels 45 (FIG. 4B). In one embodiment, the paths of the various discharge channels 45 are all the same length so that liquid is evenly distributed on the actuator top surface 74 with every pump assembly stroke achieved upon reciprocation of the actuator 24.

When a user pushes actuator 24 down, discharge tube 40 to which actuator 24 is coupled also moves down and liquid is initially discharged from the pump assembly 26, as described above, through discharge tube 40 until the coil spring 56 is fully compressed. During downward movement of the piston head 42 liquid is forced out through the discharge tube 40, past the compressed sealing plug 65, to the liquid distribution system, and to the distribution orifices 25.

After the actuator 24 is released by the user and returns to its rest position, excess liquid may flow by gravity through the distribution orifices 25, through the liquid distribution system, through the discharge tube 40, and through the pump assembly 26, as described above with reference to FIG. 5A-5D, to the container 22. Thus, a complete reciprocation cycle of actuator 24 is complete. Additional, reciprocations of the actuator 24 repeat the cycle. With repeat rapid reciprocations of the actuator liquid will be repeatedly pumped from the container and excess liquid will return to the container 22 as described when reciprocation ceases and actuator 24 is left in its rest position and container 22 is in an upright configuration. The return of liquid from the actuator 24 as described, may be accomplished with an below the piston head type liquid through-pump liquid drain-back subsystem (FIG. 5A) or with an above the piston head type liquid through-pump liquid drain-back subsystem (FIG. 5B).

FIG. 4B shows a side view of another embodiment of a liquid distribution subsystem and a through-pump liquid drain-back subsystem for a dispensing package of the present invention. The liquid distribution subsystem of FIG. 4B shows an embodiment of a manifold type distribution subsystem where a plurality of vertical discharge channels 45 are each attached to a respective lengthwise discharge manifold 47 that spans nearly the entire length 78 of the vertical projection of the actuator top 72. In one embodiment of the present invention, four discharge channels 45 are attached to the lengthwise discharge manifold 47 with the four discharge channels 45 substantially equally spaced across the length 78 of the vertical projection of the actuator top 72. Typically, between 2 and 12 discharge channels 45 may be attached to the lengthwise discharge manifold 47.

Discharge channels 45 may fluidly connect the discharge tube 40 with corresponding discharge orifices 43 terminating respective discharge channels 45. The discharge orifices 43 or 25 may span a significant portion of the actuator top 72, thereby providing liquid flow to an area of the actuator top 72 larger than the diameter of the discharge tube 40. Typically, the discharge orifices 43 may span between about 60 to about 95% of the length 78 of the top surface 72.

The liquid distribution subsystem of FIG. 4B further includes a through-pump liquid drain-back subsystem for a dispensing package along the same pathway of the liquid distribution system, as described above with reference to FIG. 4A. The through-pump liquid drain-back subsystem allows excess liquid, delivered to the actuator 24 during reciprocation of the actuator 24, to return to the container 22 when reciprocation ceases and the container 22 is in an upright configuration.

Figure 4C:
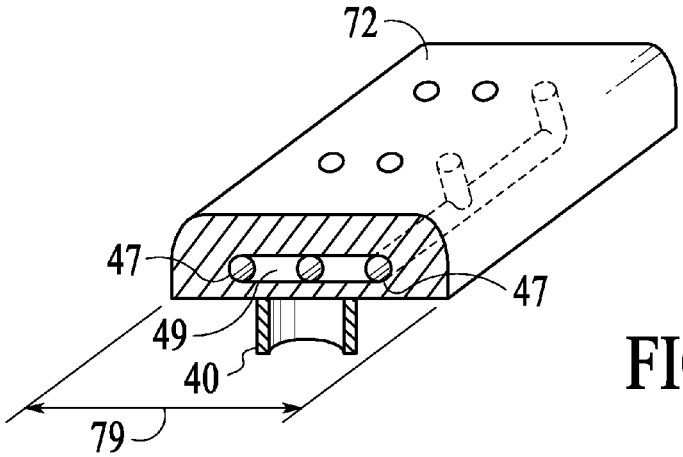
FIG. 4C shows a side cross-sectional view of another embodiment of a liquid distribution subsystem for use with the dispensing package of the present invention.

FIG. 4C shows a cross-sectional view of an embodiment of a manifold type distribution subsystem where multiple lengthwise manifolds 47 are fluidly connected to the hollow discharge tube 40 via a respective widthwise manifold 49. For example, three lengthwise manifolds 47 may be equally spaced across the width 79 of the actuator top 72. Typically, between 2 and 6 lengthwise manifolds 47 may be fluidly connected to the widthwise manifold 49.

The liquid distribution subsystem of FIG. 4C further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration.

Figure 6:
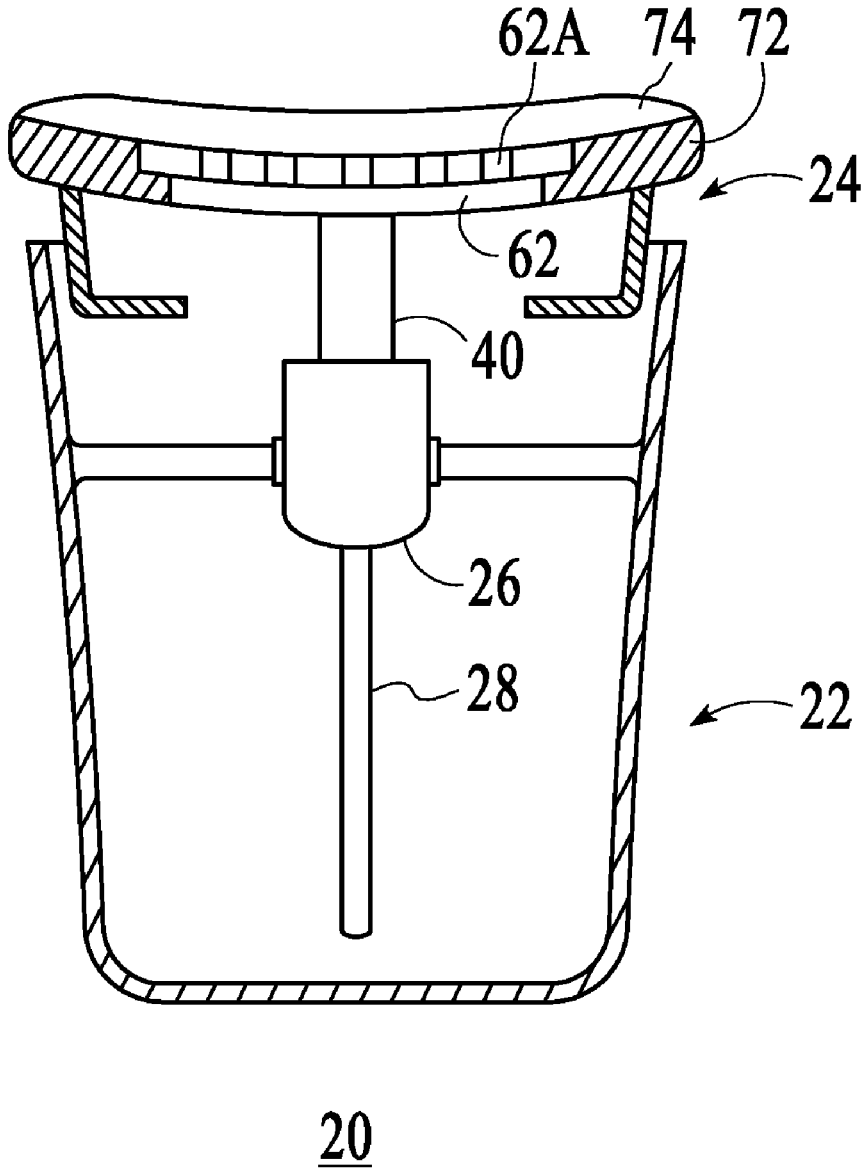
FIG. 6 shows a side cross-sectional view of another embodiment of a dispensing package of the present invention having a liquid distribution subsystem and a through-pump liquid drain-back subsystem.

FIG. 6 shows a side cross-sectional view of another embodiment of a dispensing package of the present invention having a liquid distribution subsystem and a through-valve liquid drain-back subsystem. In FIG. 6, the dispensing package includes a fluid distribution subsystem having a shallow fluid reservoir 62 that distributes the fluid to the surface holes 62*a* that go through the actuator top 72 to the actuator top surface 74. The holes 62*a* may deliver the fluid on the actuator top surface 74 of actuator top 72 of actuator 24 in an area greater than conventional methods, which may deliver fluid on the actuator 24 in only the location defined by the circumferential area of the discharge tube 40.

The liquid distribution subsystem for the dispensing package of FIG. 6 further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration.

FIG. 7 shows a cross-sectional view of a dispensing package 80 that has a distribution pad 82 that remains stationary relative to a container 90. An actuator 84 may be flush with a surface 86 of the distribution pad 82 or alternatively, may extend therefrom, such as about 1/16" to about ½" above the surface 86 of the distribution pad 82. Gaps 87 between the actuator 84 and the distribution pad 82 are present. Thus, the actuator 84 may move relative to the container 90, as shown by arrow 106 when depressed by a user. The dispensing package 80 may include a mechanism such as a trigger mechanism (not shown), as would be known to one of ordinary skill in the art, to translate the stroke of the actuator 84, when depressed by the user, into a stroke of the stem 89 that is longer than the stroke of the actuator 84.

A pump assembly 26 may be actuated by depressing the actuator 84. A stem 89 may connect the actuator 84 with the pump assembly 26. The stem 89 may be connected to a pump assembly piston (not shown in FIG. 7, see FIG. 4A) in the pump assembly 26. In some embodiments of the present invention, more than one stem 89 may connect the actuator 84 with the pump assembly 26. At least one liquid distribution tube 92 may fluidly connect the pump assembly 26 with an orifice 94 at the surface 86 of the distribution pad 82. The liquid distribution tube 92 may split into channels as described above for various embodiments of the dispensing packages described above (see FIG. 4A for example) to distribute liquid from the pump assembly 26 to a plurality of orifices 94. Alternatively, a plurality of liquid distribution tubes 92 may fluidly connect the pump assembly 26 to each of a plurality of orifices 94. A dip tube 96 may fluidly connect a bottom inside 98 of the container 90 with the pump assembly 26.

Figure 8A:
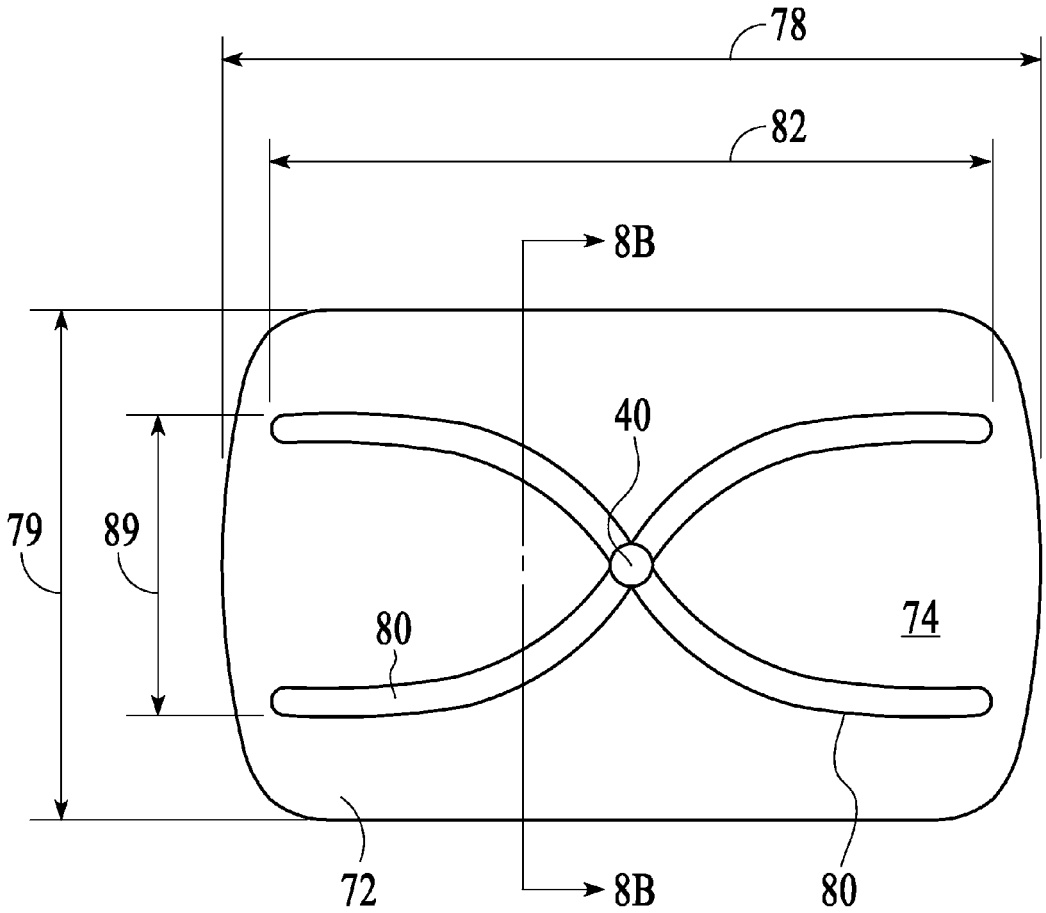
FIG. 8A shows a top view of another embodiment of a liquid distribution subsystem and a through-pump liquid drain-back subsystem for the dispensing package of the present invention.

The liquid distribution subsystem of the dispensing package of FIG. 7 further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration FIG. 8A shows a top view of another embodiment of a liquid distribution subsystem for use with the dispensing package of the present invention. The embodiment of FIG. 8A shows a surface distribution channel type liquid distribution subsystem having a surface distribution channel 80 along the top surface 74 of the actuator top 72. Liquid enters the surface distribution channel 80 from the discharge tube 40 when the actuator 74 is depressed. The surface distribution channel 80 may span a portion of the actuator top surface 74. For example, the maximum length 82 of the surface distribution channel 80 across the top surface 74 may be from about 60 to about 95% of the length 78 of the top surface 74. Similarly, the maximum width 84 of the surface distribution channel 80 across the top surface 74 may be from about 60 to about 95% of the width 79 of the top surface 74.

Figure 8B:
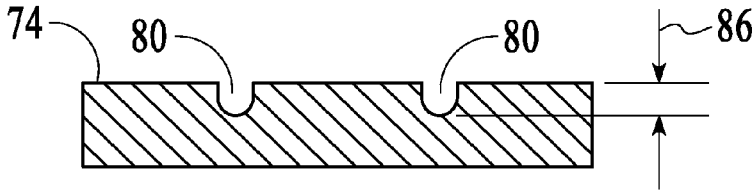
FIG. 8B shows a side cross-sectional view along line 8B-8B of FIG. 8A.

FIG. 8B shows a side cross-sectional view along line 8B-8B of FIG. 8A The surface distribution channel 80 may have a depth 86 from about ½ mm to about 10 mm. The actual depth 86 may be chosen depending on the application. A deeper depth 86 may allow more liquid to be dispensed in a single actuation of the pump assembly and may be useful in those applications where a larger volume of liquid is needed. While FIGS. 8A and 8B have an X-shaped surface distribution channel 80, other configurations of the surface distribution channel 80 may be used so long as the surface distribution channel 80 passes over discharge tube 40 and covers an area of the top surface 74 larger than the circumferential area of the discharge tube 40 alone. While the surface distribution channel 80 is shown as being semi-circular, any cross-sectional shape may be useful in the present invention.

Figure 9A:
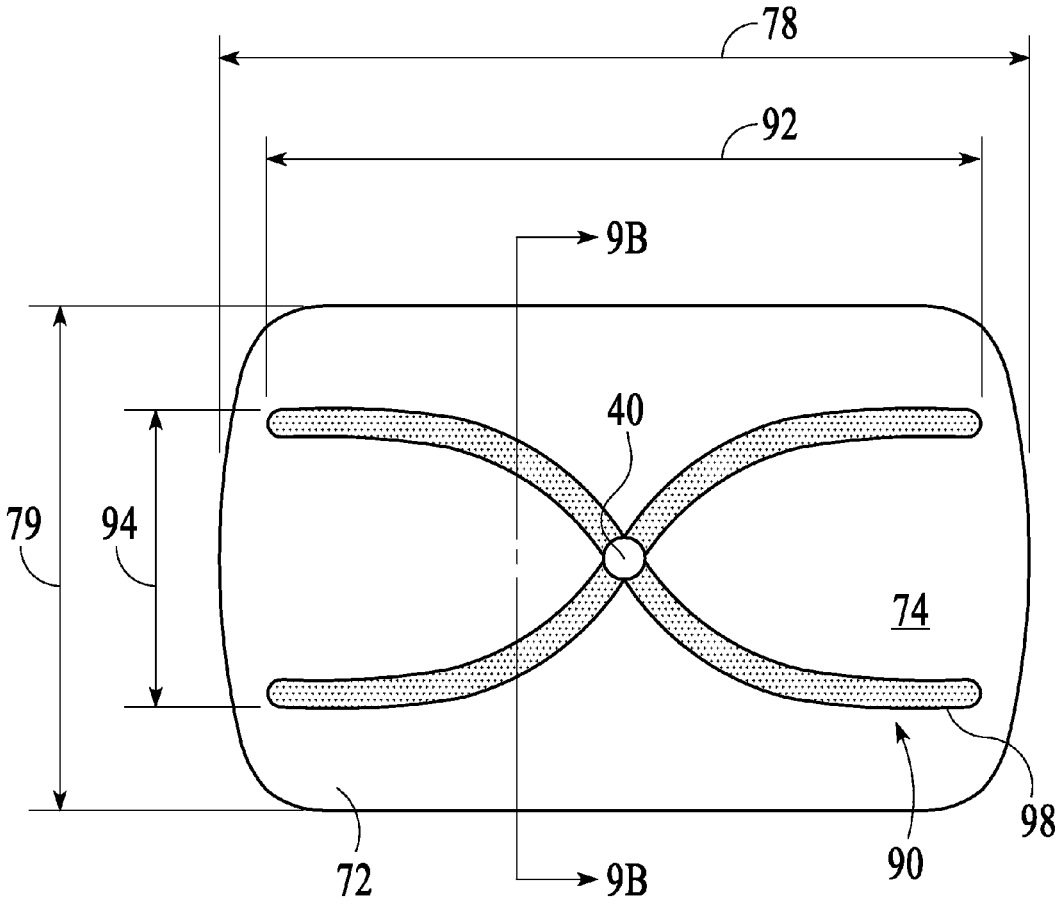
FIG. 9A shows a top view of another embodiment of a liquid distribution subsystem and a through-pump liquid drain-back subsystem for the dispensing package of the present invention.

The liquid distribution subsystem of FIG. 8A further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration FIG. 9A shows an embodiment of a surface distribution channel type liquid distribution subsystem having a surface distribution channel 90 along the top surface 74 of the actuator top 72. Liquid enters the surface distribution channel 90 from the discharge tube 40 when the actuator 74 is depressed. The surface distribution channel 90 may span a portion of the actuator top surface 74. For example, the maximum length 92 of the surface distribution channel 90 across the top surface 74 may be from about 60 to about 95% of the length 78 of the top surface 74. Similarly, the maximum width 94 of the surface distribution channel 90 across the top surface 74 may be from about 60 to about 95% of the width 79 of the top surface 74. Foam 98 may be fitted into the surface distribution channel 90. The foam 98 may be any conventional foam capable of absorbing a liquid and releasing that liquid to a substrate, such as a paper towel, sponge or the like when the foam 98 is compressed with the substrate.

Figure 9B:
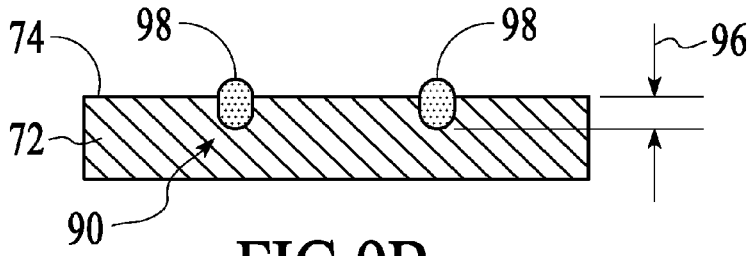
FIG. 9B shows a side cross-sectional view along line 9B-9B of FIG. 9A.

FIG. 9B shows a cross-sectional view along line 9B-9B of FIG. 9A. The surface distribution channel 90 may have a depth 96 from about 1 mm to about 20 mm. The actual depth 96 may be chosen depending on the application. A deeper depth 96 may allow more liquid to be dispensed in a single actuation of the pump assembly and may be useful in those applications where a larger volume of liquid is needed. The foam 98 may be of any shape to fit the contours of the surface distribution channel 90. As shown in FIG. 9B, the foam 98 may have a circular cross-section with at least a portion of the foam 98, typically about 50% of the foam 98, extending above the top surface 74 of the actuator top 72. While FIGS. 9A and 9B have an X-shaped surface distribution channel 90, other configurations of the surface distribution channel 90 may be used so long as the surface distribution channel 90 passes over discharge tube 40 and covers an area of the top surface 74 larger than the circumferential area of the discharge tube 40 alone.

Figure 10A:
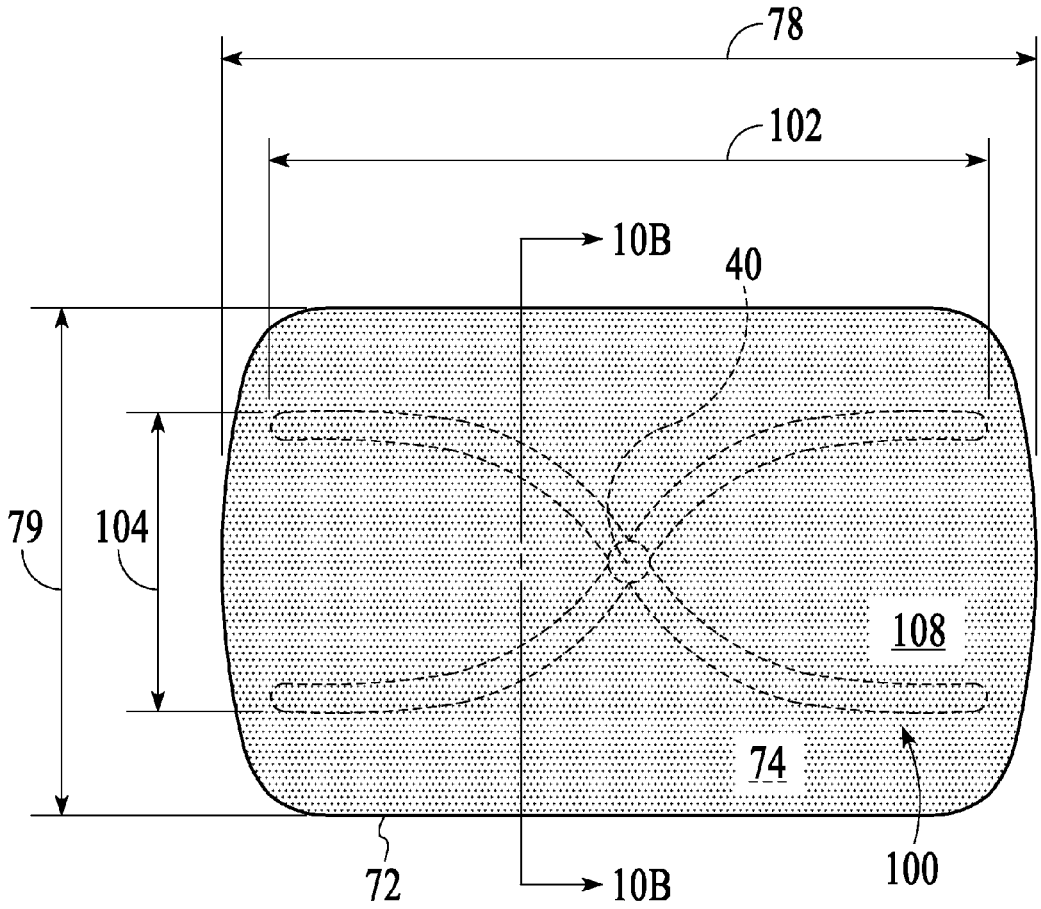
FIG. 10A shows a top view of another embodiment of a liquid distribution subsystem and a through-pump liquid drain-back subsystem for the dispensing package of the present invention.

The liquid distribution subsystem of FIG. 9A further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration FIG. 10A shows an embodiment of a liquid distribution subsystem having a surface distribution channel 100 along a top surface 74 of an actuator top 72. Liquid enters the surface distribution channel 100 from the discharge tube 40 when the actuator 24 (not shown) is depressed. The surface distribution channel 100 may span a portion of the actuator top surface 74. For example, the maximum length 102 of the surface distribution channel 100 across the top surface 74 may be from about 60 to about 95% of the length 78 of the top surface 74. Similarly, the maximum width 104 of the surface distribution channel 100 across the top surface 74 may be from about 60 to about 95% of the width 79 of the top surface 74. A foam covering 108 may cover the top surface 74 such that liquid disbursed into the surface distribution channels 100 may be absorbed by the foam covering 108. When a paper towel, sponge or the like is pressed down on the foam covering 108, the liquid may be released from the foam covering 108 into the paper towel, sponge or the like.

Figure 10B:
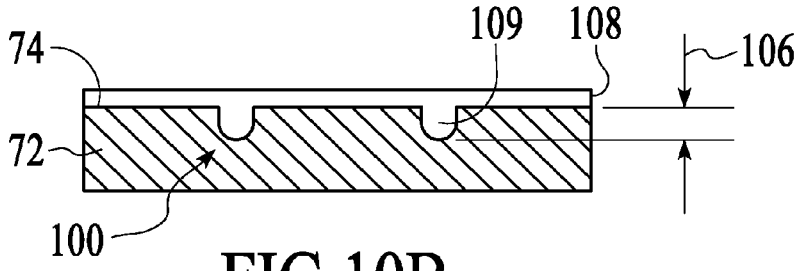
FIG. 10B shows a side cross-sectional view along line 10B-10B of FIG. 10A.

FIG. 10B shows a cross-sectional view along line 10B-10B of FIG. 10A. The surface distribution channel 100 may have a depth 106 from about 1 mm to about 20 mm. The actual depth 106 may be chosen depending on the application. A deeper depth 106 may allow more liquid to be dispensed in a single actuation of the pump assembly and may be useful in those applications where a larger volume of liquid is needed. The foam covering 108 may be of any shape and size to fit on the top surface 74 while covering the surface distribution channel 100. The foam covering 108 may have foam protrusions 109 attached to or formed integrally with the foam covering 108. The foam protrusions 109 are shaped the same as the shape of the surface distribution channel 100 thereby allowing the foam protrusions 109 to fit into the surface distribution channel 100 when the foam covering 108 is placed on the top surface 74. While FIGS. 10A and 10B have an X-shaped surface distribution channel 100, other configurations of the surface distribution channel 100 may be used so long as the surface distribution channel 100 passes over discharge tube 40 and covers an area of the top surface 74 larger than the circumferential area of the discharge tube 40 alone.

Figure 11A:
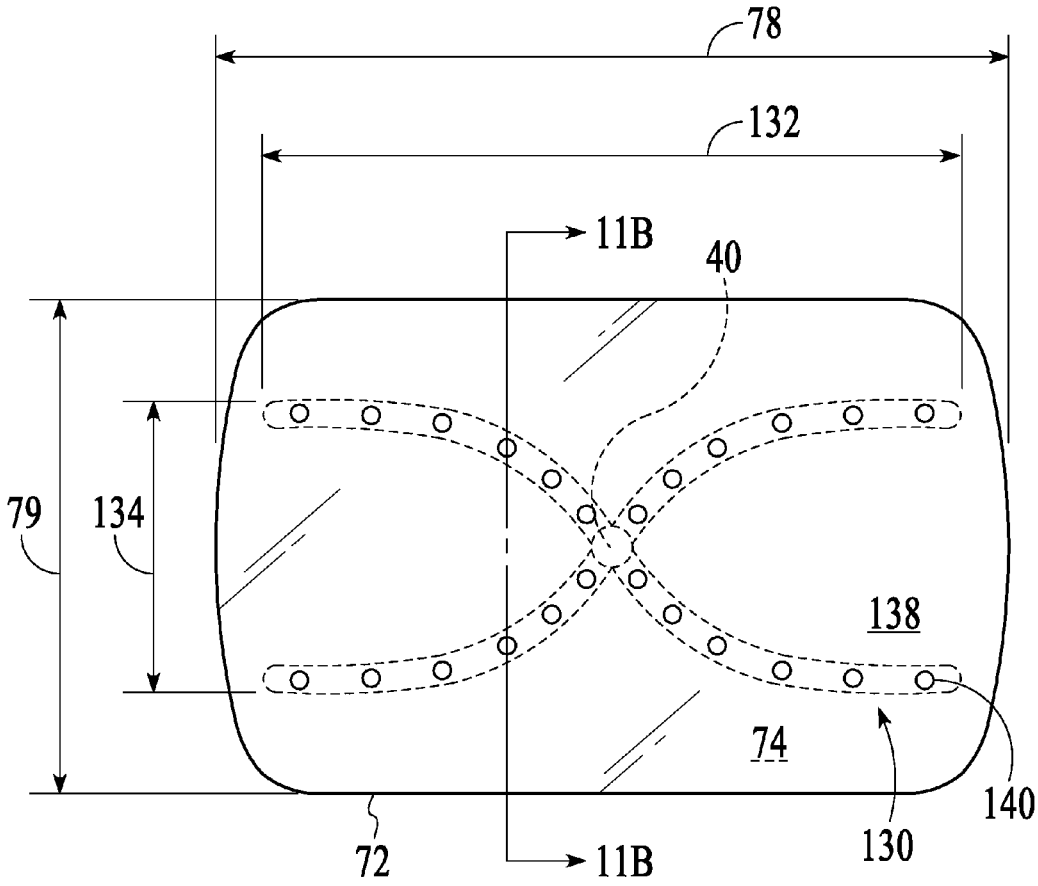
FIG. 11A shows a top view of another embodiment of a liquid distribution subsystem and a through-pump liquid drain-back subsystem for the dispensing package the present invention.

The liquid distribution subsystem of FIG. 10A further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration FIG. 11A shows an embodiment of a liquid distribution subsystem having a surface distribution channel 130 along a top surface 74 of an actuator top 72. Liquid enters the surface distribution channel 130 from a discharge tube 40 when the actuator 24 (not shown) is depressed. The surface distribution channel 130 may span a portion of the actuator top surface 74. For example, the maximum length 132 of the surface distribution channel 130 across the top surface 74 may be from about 60 to about 95% of the length 78 of the top surface 74. Similarly, the maximum width 134 of the surface distribution channel 130 across the top surface 74 may be from about 60 to about 95% of the width 79 of the top surface 74. A thin layer 138 may be attached to the top surface 74 of the actuator top 72. The thin layer 138 may be made of, for example, polyethylene, polypropylene, polyethylene terephthalate or the like. Holes 140 may be formed in the thin layer 138 to allow liquid to pass from the surface distribution channel 130 to a top surface 142 (FIG. 11B) of the flexible layer 138. Holes 140 are formed directly above the surface distribution channel 130 as shown in FIG. 11A. When the liquid fills the surface distribution channel 130, liquid may then pass through the holes 140 to the top surface 142 of the flexible layer 138.

Figure 11B:
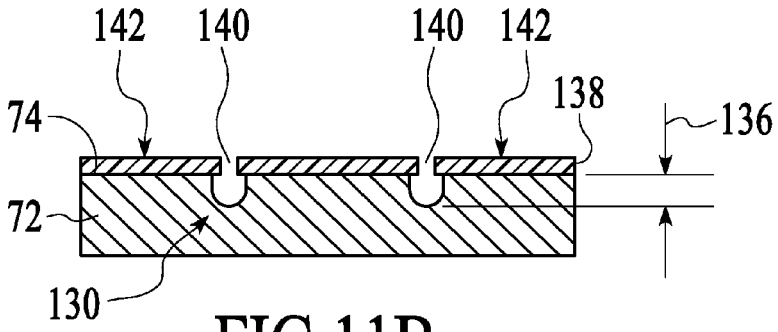
FIG. 11B shows a side cross-sectional view along line 11B-11B of FIG. 11A.

FIG. 11B shows a cross-sectional view along line 11B-11B of FIG. 11A. The surface distribution channel 130 may have a depth 136 from about ½ mm to about 20 mm. The actual depth 136 may be chosen depending on the application. A deeper depth 136 may allow more liquid to be dispensed in a single actuation of the pump assembly and may be useful in those applications where a larger volume of liquid is needed. While FIGS. 24A and 24B have an X-shaped surface distribution channel 140, other configurations of the surface distribution channel 140 may be used so long as the surface distribution channel 140 passes over discharge tube 40 and covers an area of the top surface 74 larger than the circumferential area of the discharge tube 40 alone.

The liquid distribution subsystem of FIG. 11A further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration.

Figure 12A:
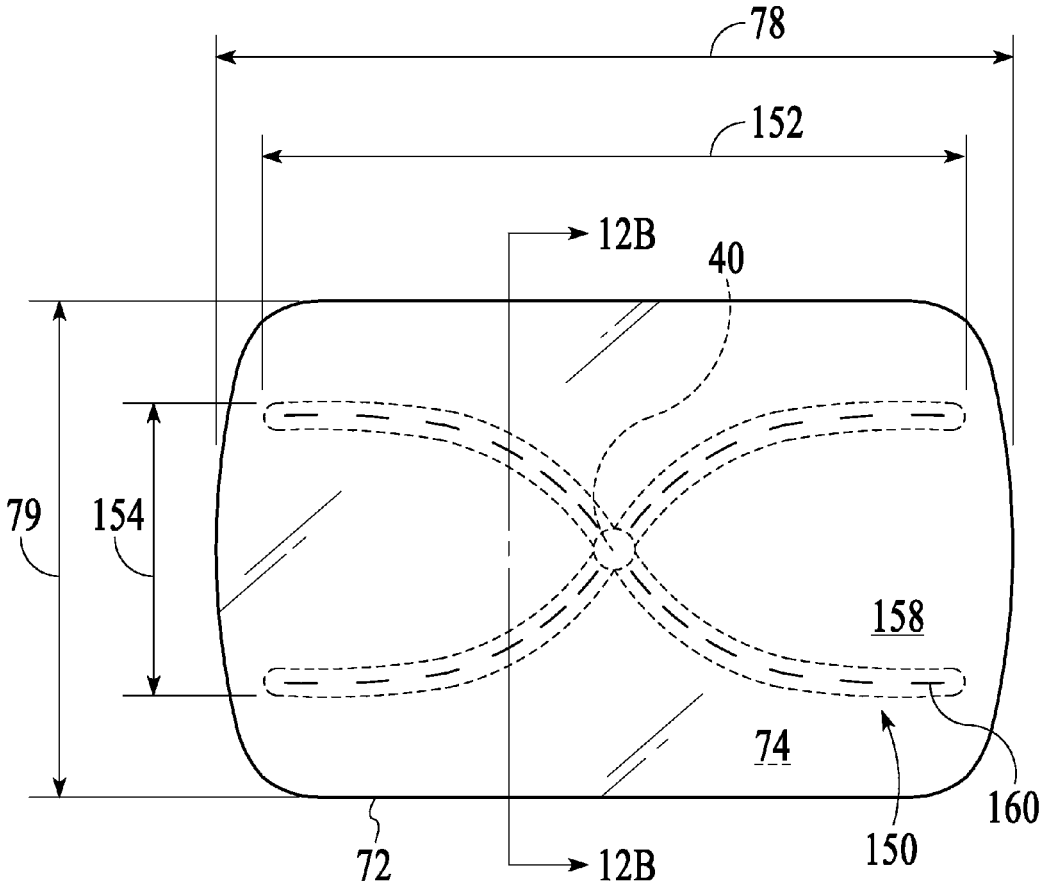
FIG. 12A shows a top view of another embodiment of a liquid distribution subsystem and a through-pump liquid drain-back subsystem for the dispensing package of the present invention.

FIG. 12A shows an embodiment of a liquid distribution subsystem having a surface distribution channel 150 along a top surface 74 of an actuator top 72. Liquid enters the surface distribution channel 150 from the discharge tube 40 when the actuator 24 (not shown) is depressed. The surface distribution channel 150 may span a portion of the actuator top surface 74. For example, the maximum length 152 of the surface distribution channel 150 across the top surface 74 may be from about 60 to about 95% of the length 78 of the top surface 74. Similarly, the maximum width 154 of the surface distribution channel 150 across the top surface 74 may be from about 60 to about 95% of the width 79 of the top surface 74. A flexible layer 158 may be attached to the top surface 74 of the actuator top 72. The flexible layer 158 may be made of, for example, silicone, thermal plastic elastomer, low density polyethylene or the like. Slits 160 may be formed in the flexible layer 158 to allow liquid to pass from the surface distribution channel 150 to a top surface 162 of the flexible layer 158. Slits 160 are formed over the surface distribution channel 150 as shown in FIG. 12A. When the liquid in the surface distribution channel 150 becomes pressurized, the pressure flexes the flexible layer 158 to open the slits 160 to allow liquid to pass from the surface distribution channel 150 through the slits 160 and to the top surface 162 of the flexible layer 158. This design may prevent the backflow of liquid from the top surface 162 of the flexible layer 158 to the discharge tube 40, thereby potentially contaminating the contents of the container (not shown). A simple linear slit may be used as shown, two or more crossing slits may open with less force and still close when the pressure is released.

Figure 12B:
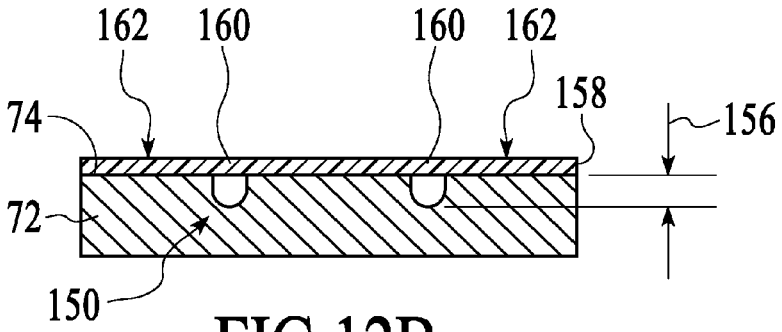
FIG. 12B shows a side cross-sectional view along line 11301302B-12B of FIG. 12A.

FIG. 12B shows a cross-sectional view along line 12B-12B of FIG. 12A. The surface distribution channel 150 may have a depth 156 from about ½ mm to about 20 mm. The actual depth 156 may be chosen depending on the application. A deeper depth 156 may allow more liquid to be dispensed in a single actuation of the pump assembly and may be useful in those applications where a larger volume of liquid is needed. While FIGS. 12A and 12B have an X-shaped surface distribution channel 150, other configuration of the surface distribution channel 150 may be used so long as the surface distribution channel 150 passes over discharge tube 40 and covers an area of the top surface 74 larger than the circumferential area of the discharge tube 40 alone.

The liquid distribution subsystem of FIG. 12A further includes a through-pump liquid drain-back subsystem for a dispensing package along the same pathway of the liquid distribution system, as described above, to allow excess liquid, delivered to the actuator 24 during reciprocation of the actuator 24, to return to the container 22 when reciprocation ceases and the container 22 is in an upright configuration Additional Functional Features In one embodiment, additional functional characteristics designed into the container base to offer stability and to encourage consumers to leave the product out on their counters so it is easily accessible. In one embodiment, a means is provided to allow the container to attach to the counter. One such example is a suction cup or other device on the bottom of the container. In addition to standing upright, for example on a counter-top, the dispensing package may be attached to a surface and used with the dispensing package discharge orifices on the bottom, for example attached to the underside of kitchen cabinets.

In one embodiment, the exterior of the dispensing package is resistant to microorganisms. Various anti-microbial agents known in the art can be applied the exterior surface of the dispensing package to impart virucidal, bacterial, and/or germicidal properties thereto. The anti-microbial agent can comprise up to 100% of the surface area of the exterior surface of the dispenser, and in some embodiments, between about 10% to about 80%. The anti-microbial agent can include silver ions. In certain embodiments, a silver-zeolite complex can be utilized to provide controlled release of the anti-microbial agent. One commercially available example of such a time-release anti-microbial agent is sold as a fabric by HEALTH SHIELD® under the name GUARDTEX®, and is constructed from polyester and rayon and contains a silver-zeolite complex. Other suitable silver-containing microbial agents are disclosed in Japanese Unexamined Patent No. JP 10/259325. Moreover, in addition to silver-zeolites, other metal-containing inorganic additives can also be used in the present invention. Examples of such additives include, but are not limited to, copper, zinc, mercury, antimony, lead, bismuth, cadmium, chromium, thallium, or other various additives, such as disclosed in Japanese Patent No. JP 1257124 A and U.S. Pat. No. 5,011,602 to Totani, et al. In some embodiments, the activity of the additive can also be increased, such as described in U.S. Pat. No. 5,900,383 to Davis, et al.

Substrate

Potential substrates or tools that consumers could use with the dispensing package include woven or nonwoven dish cloths, sponges, paper towel, hands, facial tissue, bathroom tissue, paper, napkins, woven and nonwoven substrates, towels, wipes, and cotton balls. The dispensing package could also be used with clothes for stain removal purposes. Suitable substrates can comprise personal, cosmetic or sanitary wipes, baby wipes, hand wipes, wipes used in car cleaning, household or institutional cleaning or maintenance, computer cleaning and maintenance and any other area in which a flexible substrate having a useful liquid treatment composition has application. These substrates (tissues or wipes) can be made from simple nonwovens, complex nonwovens or treated, high-strength durable materials. The substrate can be two-sided or have a barrier so that only one side is wet with the composition upon use. Such substrates are described in U.S. Pat. App. 2005/0079987 to Cartwright et al.

Compositions

The composition can contain virtually any useful liquid compositions. Simple liquids such as water, alcohol, solvent, etc. can be useful in a variety of end uses, particularly cleaning and simple wiping applications. The liquid can be a simple cleaner, maintenance item or a personal care liquid suitable for dermatological contact with an adult, child or infant. Such compositions can be used in hospitals, schools, offices, kitchens, secretarial stations, etc. The compositions can also comprise more complex liquids in the forms of solutions, suspensions or emulsions of active materials in a liquid base. In this regard, such compositions can be active materials dissolved in an alcoholic base, aqueous solutions, water in oil emulsions, oil in water emulsions, etc. Such compositions can be cleaning materials, sanitizing materials, or personal care materials intended for contact with human skin, hair, nails, etc. Cleaning compositions used generally for routine cleaning operations not involving contact with human skin can often contain a variety of ingredients including, in aqueous or solvent base, a soil-removing surfactant, sequestrants, perfumes, etc. in relatively well-known formulations. Sanitizing compositions can contain aqueous or alcoholic solutions containing sanitizing materials such as triclosan, hexachlorophene, betadine, quaternary ammonium compounds, oxidizing agents, acidic agents, and other similar materials. Such compositions can be designed for treating or soothing human skin, including moisturizers, cleansing creams and lotions, cleansers for oily skin, deodorants, antiperspirants, baby-care products, sun block, sun screen, cosmetic-removing formula, insect repellent, etc. Moisturizer materials are preparations that reduce water loss or the appearance of water loss from skin. Cleansing creams or lotions can be developed that can permit the formulation to dissolve or lift away soil pigments, grime and dead skin cells. These creams or lotions can also be enhanced to improve removability of makeup and other skin soils. Cleaners for oily skin are often augmented with ethyl alcohol or isopropyl alcohol to increase the ability of the cleaner to remove excess oily residue. Deodorants and antiperspirants often contain, in an aqueous base, dispersions or emulsions comprising aluminum, zinc or zirconium compounds.

The composition may contain one or more additional surfactants selected from nonionic, anionic, cationic, ampholytic, amphoteric and zwitterionic surfactants and mixtures thereof. A typical listing of anionic, ampholytic, and zwitterionic classes, and species of these surfactants, is given in U.S. Pat. No. 3,929,678 to Laughlin and Heuring. A list of suitable cationic surfactants is given in U.S. Pat. No. 4,259,217 to Murphy. Where present, anionic, ampholytic, amphotenic and zwitteronic surfactants are generally used in combination with one or more nonionic surfactants. The surfactants may be present at a level of from about 0% to 90%, or from about 0.001% to 50%, or from about 0.01% to 25% by weight.

The compositions may contain suitable organic solvents including, but are not limited to, $C_{1-6}$ alkanols, $C_{1-6}$ diols, $C_{1-10}$ alkyl ethers of alkylene glycols, $C_{3-24}$ alkylene glycol ethers, polyalkylene glycols, short chain carboxylic acids, short chain esters, isoparafinic hydrocarbons, mineral spirits, alkylaromatics, terpenes, terpene derivatives, terpenoids, terpenoid derivatives, formaldehyde, and pyrrolidones. Alkanols include, but are not limited to, methanol, ethanol, n-propanol, isopropanol, butanol, pentanol, and hexanol, and isomers thereof. Diols include, but are not limited to, methylene, ethylene, propylene and butylene glycols. Alkylene glycol ethers include, but are not limited to, ethylene glycol monopropyl ether, ethylene glycol monobutyl ether, ethylene glycol monohexyl ether, diethylene glycol monopropyl ether, diethylene glycol monobutyl ether, diethylene glycol monohexyl ether, propylene glycol methyl ether, propylene glycol ethyl ether, propylene glycol n-propyl ether, propylene glycol monobutyl ether, propylene glycol t-butyl ether, di- or tri-polypropylene glycol methyl or ethyl or propyl or butyl ether, acetate and propionate esters of glycol ethers. Short chain carboxylic acids include, but are not limited to, acetic acid, glycolic acid, lactic acid and propionic acid. Short chain esters include, but are not limited to, glycol acetate, and cyclic or linear volatile methylsiloxanes. Water insoluble solvents such as isoparafinic hydrocarbons, mineral spirits, alkylaromatics, terpenoids, terpenoid derivatives, terpenes, and terpenes derivatives can be mixed with a water-soluble solvent when employed. The solvents can be present at a level of from 0.001% to 10%, or from 0.01% to 10%, or from 1% to 4% by weight.

The compositions optionally contain one or more of the following adjuncts: stain and soil repellants, lubricants, odor control agents, perfumes, fragrances and fragrance release agents, and bleaching agents. Other adjuncts include, but are not limited to, acids, electrolytes, dyes and/or colorants, solubilizing materials, stabilizers, thickeners, defoamers, hydrotropes, cloud point modifiers, preservatives, and other polymers. The solubilizing materials, when used, include, but are not limited to, hydrotropes (e.g. water soluble salts of low molecular weight organic acids such as the sodium and/or potassium salts of toluene, cumene, and xylene sulfonic acid). The acids, when used, include, but are not limited to, organic hydroxy acids, citric acids, keto acid, and the like. Suitable organic acid can be selected from the group consisting of citric acid, lactic acid, malic acid, salicylic acid, acetic acid, adipic acid, fumaric acid, hydroxyacetic acid, dehydroacetic acid, glutaric acid, tartaric acid, fumaric acid, succinic acid, propionic acid, aconitic acid, sorbic acid, benzoic acid, gluconic acid, ascorbic acid, alanine, lysine, and mixtures thereof. Electrolytes, when used, include, calcium, sodium and potassium chloride. Thickeners, when used, include, but are not limited to, polyacrylic acid, xanthan gum, calcium carbonate, aluminum oxide, alginates, guar gum, methyl, ethyl, clays, and/or propyl hydroxycelluloses. Defoamers, when used, include, but are not limited to, silicones, aminosilicones, silicone blends, and/or silicone/hydrocarbon blends. Bleaching agents, when used, include, but are not limited to, peracids, hypohalite sources, hydrogen peroxide, and/or sources of hydrogen peroxide. When cleaning food contact surfaces, compositions for use herein may contain only materials that are food grade or GRAS, including, of course, direct food additives affirmed as GRAS, to protect against possible misuse by the consumer.

Preservatives, when used, include, but are not limited to, mildewstat or bacteriostat, methyl, ethyl and propyl parabens, short chain organic acids (e.g. acetic, lactic and/or glycolic acids), bisguanidine compounds (e.g. Dantagard® and/or Glydant®) and/or short chain alcohols (e.g. ethanol and/or IPA). The mildewstat or bacteriostat includes, but is not limited to, mildewstats (including non-isothiazolone compounds) include Kathon® GC, a 5-chloro-2-methyl-4-isothiazolin-3-one, Kathon® ICP, a 2-methyl-4-isothiazolin-3-one, and a blend thereof, and Kathon® 886, a 5-chloro-2-methyl-4-isothiazolin-3-one, all available from Rohm and Haas Company; BRONOPOL®, a 2-bromo-2-nitropropane 1,3 diol, from Boots Company Ltd., PROXEL® CRL, a propyl-p-hydroxybenzoate, from ICI PLC; NIPASOL® M, an o-phenyl-phenol, $Na^+$ salt, from Nipa Laboratories Ltd., DOWICIDE® A, a 1,2-Benzoisothiazolin-3-one, from Dow Chemical Co., and IRGASAN® DP 200, a 2,4,4'-trichloro-2-hydroxydiphenylether, from Ciba-Geigy A.G.

The compositions can contain antimicrobial agents, including 2-hydroxycarboxylic acids and other ingredients, including quaternary ammonium compounds and phenolics. Non-limiting examples of these quaternary compounds include benzalkonium chlorides and/or substituted benzalkonium chlorides, di(C6-C14)alkyl di-short chain (C1-4 alkyl and/or hydroxyalkl) quaternaryammonium salts, N-(3-chloroallyl) hexaminium chlorides, benzethonium chloride, methylbenzethonium chloride, and cetylpyridinium chloride. Other quaternary compounds include the group consisting of dialkyldimethyl ammonium chlorides, alkyl dimethylbenzylammonium chlorides, dialkylmethyl-benzylammonium chlorides, and mixtures thereof. Biguamide antimicrobial actives including, but not limited to polyhexa-methylene biguamide hydrochloride, p-chlorophenyl biguamide; 4-chlorobenzhydryl biguamide, halogenated hexidine such as, but not limited to, chlorhexidine (1,1'-hexamethylene-bis-5-(4-chlorophenyl biguamide) and its salts are also in this class. Another class of antibacterial agents, which are useful in the present invention, are the so-called "natural" antibacterial actives, referred to as natural essential oils. These actives derive their names from their natural occurrence in plants. Typical natural essential oil antibacterial actives include oils of anise, lemon, orange, rosemary, wintergreen, thyme, lavender, cloves, hops, tea tree, citronella, wheat, barley, lemongrass, cedar leaf, cedarwood, cinnamon, fleagrass, geranium, sandalwood, violet, cranberry, eucalyptus, vervain, peppermint, gum benzoin, basil, fennel, fir, balsam, menthol, ocmea origanum, *Hydastis carradenisis*, Berberidaceae daceae, Ratanhiae and *Curcunta longa*. Also included in this class of natural essential oils are the key chemical components of the plant oils which have been found to provide the antimicrobial benefit. These chemicals include, but are not limited to anethol, catechole, camphene, carvacol, eugenol, eucalyptol, ferulic acid, farnesol, hinokitiol, tropolone, limonene, menthol, methyl salicylate, thymol, terpineol, verbenone, berberine, ratanhiae extract, caryophellene oxide, citronellic acid, curcumin, nerolidol and geraniol. Other suitable antimicrobial actives include antibacterial metal salts. This class generally includes salts of metals in groups 3b-7b, 8 and 3a-5a. Specifically are the salts of aluminum, zirconium, zinc, silver, gold, copper, lanthanum, tin, mercury, bismuth, selenium, strontium, scandium, yttrium, cerium, praseodymiun, neodymium, promethum, samarium, europium, gadolinium, terbium, dysprosium, holmium, erbium, thulium, ytterbium, lutetium and mixtures thereof.

When the composition is an aqueous composition, water can be, along with the solvent, a predominant ingredient. The water should be present at a level of less than 99.9%, more preferably less than about 99%, and most preferably, less than about 98%. Deionized water is preferred. Where the cleaning composition is concentrated, the water may be present in the composition at a concentration of less than about 85 wt. %.

The dispenser can be used to transfer a wide variety of compositions to a substrate. These compositions include hard surface cleaners and sanitizers, personal care cleaners and other products, hand sanitizers, dish soap, laundry pre-treater, food products such as marinades, car products such as cleaners or protectants, and baby care products such as baby lotion. Also, suitable are compositions, such as hypochlorite especially dilute (below 500 ppm) hypochlorite, that lack good stability on nonwoven substrates. Other examples of compositions that may lack stability are quaternary ammonium disinfectants or metal ions that can bind to nonwoven substrates.

In one embodiment, the substrate can undergo a color change or other physical property change during the process of application using the dispenser or during the cleaning process. These changes can include color change due to the addition of a colorless cleaner/disinfectant, color change due to the addition of a composition containing a dye, color change when dye is thermochromic, and changes over time as solvent evaporates to cool the wipe, a color change due to reaction of solvent with a pre-bound species (e.g. transition metals) on the wipe, texture changes in the non-woven, and the impact of the using a dyed or patterned non-woven. The composition or substrate can incorporate solvatochromic dyes to indicate the presence of bacteria as described in U.S. Pat. App. 2005/0130253. In one embodiment, the composition contains a dye that interacts with proteins or bacterial on surfaces to indicate whether the surface is substantially free of soil (protein) or bacteria. In one embodiment, the soil or bacteria is detected on the substrate. In one embodiment, the soil or bacteria is detected on the surface. Colorimetric assays utilizing sampling devices for the detection of protein in biological samples are commonly used across various industries (biotech, healthcare, food, etc). These sampling devices require minimal manipulation of the protein-containing samples and allow for rapid qualitative and quantitative results. Among the various available calorimetric protein assays is one disclosed in U.S. Pat. No. 4,839,295 to Smith, incorporated herein in its entirety, that utilizes a Bicinchonic Acid (BCA) protein assay. This assay is based on the initial complexation of Copper [II], hereinafter $Cu^{++}$ or cupric ion, with protein peptides under alkaline conditions, with the reduction to Copper [I], hereinafter $Cu^{+}$ or the cuprous ion, in a concentration-dependent manner. The ligand BCA is then added in excess, and a purple color develops (562 nm peak absorbance) upon binding of BCA with $Cu^{+}$. Suitable detection devices are described in U.S. Pat. App. 11/397,522 to Cumberland et al. filed Apr. 3, 2006 and U.S. Pat. App. 11/427,469 to Cumberland et al. filed Jun. 29, 2006.

Methods of Use

Consumers enjoy the ease of use of the invention for reasons such as it utilizes cleaners differently, provides control such as no overspray, can be used one-handed, is compatible with wide variety of substrates, utilizes direct application so that no particles are aerosolized into the air, allows easy multi-tasking with other household activities, and is not limited by number of doses or wipes. Because of this flexibility, the consumer has more control to make the exact use conditions suitable to the task.

The dispensing package can be used as a one-handed method of cleaning a surface, where the consumer grabs a substrate in her hand, pushes the substrate down on the reciprocating actuator top of the dispensing package with her hand, allows the actuator top to move down and discharge a cleaning composition from the dispensing package to the substrate, and wipes the surface with the substrate. The substrate can be a paper towel, facial tissue, sheet of toilet tissue, a napkin, a sponge, a towel, the consumer's fingers or any other suitable woven or nonwoven substrate. Because the cleaning task takes only one hand, the other hand is free to perform another activity, such as holding a telephone, eating a snack and the task can be done quickly and easily without carrying the dispensing package to the area of the task.

Because the consumer is unfamiliar with the one-handed method of cleaning a surface, certain use indications on the dispensing package, any exterior packaging, or on advertising may be necessary to provide the consumer instant instruction on the use of the dispensing package. In one embodiment, a hand is depicted over the dispensing package. In another embodiment, a hand holding a substrate is depicted over the dispensing package.

This method of cleaning of the invention has several advantages. If the consumer is preparing dinner and using one hand to contact raw food such as chicken that may contain microorganisms, then the consumer can use the other hand to do one-handed cleaning and disinfection of the food preparation surface, such as a countertop. Using a traditional cleaning product, such as a spray bottle and paper towel, the consumer picks up the spray bottle with the hand that has been potentially contaminated with microorganisms and transfers those microorganisms to the spray bottle. If the spray bottle or other product dispenser is contaminated with microorganisms, then the consumer can pick up and transfer microorganisms from the product dispenser. In the case of the one-handed method of the invention, the consumer contacts the product dispenser only at the actuator component which dispenses the disinfecting composition. In this case, there is less likelihood of transmission of microorganisms from dispenser to hands or from hands to dispenser.

Another advantage of the method and package of the present invention is control during delivery of the composition. With traditional spray dispensers, the consumer must attempt to fit the spray pattern of the spray bottle dispenser to the area to be cleaned. Frequently, the cleaning surface contains additional items, such as food or decorative items, which the consumer may not wish to contact with the cleaning composition. With the method and dispensing package of the invention, the consumer can controllably apply the composition to the substrate and then controllably apply the substrate containing the composition to the cleaning surface. If the consumer were to try spraying the substrate with a traditional spray dispenser, then some of the composition would be aerosolized into the air and some of the composition would miss the substrate and contact other surfaces such as the hand or food items.

Another area of concern for consumers is microorganism contaminated surfaces within the bathroom, especially around the toilet area. Consumers have ready access to toilet tissue but no ready mechanism to use it for spot cleaning. The method of the invention allows the consumer to use toilet tissue, which has limited wet strength and scrubbing strength, to spot clean surfaces around the toilet and other bathroom surfaces without using two hands and without having to pick up the dispensing package. With a suitable composition within the dispensing package, the consumer may also use the dispensing package and method of the invention for personal hygiene use.

With traditional dispensers such as trigger sprayers, the consumer has limited ability to control the pattern of dispensing the composition onto a surface or a substrate. In one case, the substrate, such as sponges, may be rectangular and the dispensing package may deliver a circular application of product. To effectively apply product to a substrate, such as a sponge, it may be desirable to apply the composition in a rectangular or oval fashion, where the applied product is dispersed more in one dimension than in the other dimension. Additionally, with the hand or a paper towel in a hand or a toilet tissue in a hand, it may also be desirable to apply the composition to the substrate in a non-circular fashion or where one dimension is greater than another. The method of the invention has the advantage that with a properly designed actuator component and discharge orifices in the activator component, it may be possible to apply a non-circular pattern with one hand motion.

Some suitable substrates will not be stable long-term to all suitable compositions, for example toilet tissue or a sheet of facial tissue quickly loses its tensile strength when saturated with cleaning composition. Therefore, it is most suitable to wet the toilet tissue or facial tissue just before use. In some cases, the substrate loses at least 40%, or 50%, or 60%, or 70%, or 80%, or 90% peak dry tensile strength in machine or cross direction upon being loaded to full saturation with the composition. Peak dry tensile strength is the maximum load that a substrate can bear before breaking\rupturing under tension. With the method of the invention, these substrates may be useful for spot cleaning.

Other compositions are not stable on typical substrates, for example hypochlorite, especially dilute hypochlorite, is not storage stable on most nonwoven substrates as described in U.S. Pat. No. 7,008,600 to Katsigras et al. Additionally, compositions of very high or low pH are not generally storage stable on wipes or paper towels. Disinfectant compositions containing quaternary ammonium disinfectants or other cationic disinfectants bind to most nonwovens, especially cellulosic nonwovens, on storage so that they are not effectively released. The extent of binding can be measured by a quaternary recovery measurement on the wet substrate. The liquid squozate is acquired from the substrate by centrifugation after a seven day minimum requisite time of substrate-lotion equilibration. Substrates are put into a centrifuged tube for analysis, centrifuged at 3000 rpm for 15 min, and the liquid analyzed by HPLC. At equilibrium, the quaternary disinfectant show substantial binding to the substrate, for example, at least 10%, or 20%, or 30%, or 40%, or 50% by weight. However, the method of the invention, since it is quick and easy, lends itself to use of unstable substrates and unstable compositions, which may not be suitable under other methods of use.

The present invention relates to disinfecting compositions which can be used to disinfect various surfaces including inanimate surfaces such as hard surfaces like walls, tiles, floors, countertops, tables, glass, bathroom surfaces, and kitchen surfaces. The hard-surfaces to treat with the compositions herein are those typically found in houses like kitchens, bathrooms, e.g., tiles, walls, floors, chrome, glass, smooth vinyl, any plastic, plasticized wood, table top, sinks, cooker tops, dishes, sanitary fittings such as sinks, showers, shower curtains, wash basins, toilets and the like. Hard-surfaces also include household appliances including, but not limited to, refrigerators, freezers, washing machines, automatic dryers, ovens, microwave ovens, dishwashers and so on.

The dispensing package can be used around the house, for example, on kitchen or bathroom surfaces. The dispensing package can be used in public places, for example, in schools and school classrooms. For use around food, a food safe cleaner or disinfectant is suitable. The dispensing package allows the user to quickly apply a sanitizing or cleaning solution to everyday cleaning tools, such as sponges, paper towels, toilet paper, facial tissue, etc. When applied, the sanitizing or cleaning solution transforms the everyday cleaning tool into effective cleaning or sanitizing tools.

Additional Embodiments

In one embodiment, the dispensing package is both a gel and mist cleaner. This dispenser is a dual dispensing cleaner that allows you to dispense one cleaner or two different cleaners in two different forms, a gel and a mist or spray. The package has a gel pump assembly on top that works with a top actuator component as described previously and a liquid misting sprayer on the side. The unit contains one cleaning bottle and optionally a wall mounting base and attachments. To use this embodiment, press and pump your paper towel on the cleaning gel actuator component. To use the misting spray, squeeze the trigger on the side.

In one embodiment, the dispensing package is a discreet and mountable cleaner dispenser. This package is a mountable cleaning product package with a press and pump dispenser. The package is thin and discreet, about the size of a flattened tissue box. It can be mounted horizontally or vertically with adhesive to surface of your choice (e.g., under cabinets, side of counter, side of toilet tank, etc.). The unit contains one dispensing package with adhesive back. In another embodiment, the dispensing package is a hangable cleaner that can be hung anywhere (e.g., shower door/curtain rod, towel rack, kitchen cabinet, shower head, etc.) with the hook on top.

In one embodiment, the dispensing package is a mountable or counter standing dispenser that automatically dispenses the composition onto your paper towel, toilet paper, sponge, rag, etc. A sensor on the dispensing package works to activate the actuator component when you hold your paper towel, toilet paper, sponge, rag, etc. under or over the actuator component. The unit package can contain wall-mounting and counter-holding suction cups, dispensing machine, refillable cleaner cartridge and battery. In one embodiment, this dispensing package is plugged into an outlet to run the sensor and pump assembly.

In one embodiment, the product or package contains directions to store the substrate on top of the package, for example a sponge on top of dispensing package actuator. In one embodiment, the product or package includes the dispensing package and substrates sold together, for example paper towels with the dispensing package. In one embodiment, several dispensing packages are bundled in multi-packs, for example a dispensing package containing dish soap and a dispensing package containing a kitchen cleaner. In one example, the dispensing package is sold with one or more refills.

While this detailed description includes specific examples according to the invention, those skilled in the art will appreciate that there are many variations of these examples that would nevertheless fall within the general scope of the invention and for which protection is sought in the appended claims.

What is claimed is:

1. A liquid dispensing package comprising:

a container adapted to contain a liquid;

an actuator having an actuator top having an actuator top surface with at least one discharge orifice in fluid communication with the container to permit flow of liquid from the container to the actuator top surface upon downward motion of the actuator;

a pump assembly coupled to and in fluid communication with the container and in fluid communication with the at least one discharge orifice wherein the pump assembly comprises a pump chamber having a pump chamber sidewall with a pump chamber sidewall opening therethrough to place the pump chamber in fluid communication with the container, wherein the pump chamber includes a pump chamber sidewall opening check valve at the pump chamber sidewall opening to prevent liquid flow from the container through the pump assembly when the container is not in a upright configuration and wherein the at least one discharge orifice permits through-pump drain-back of liquid from the top surface of the actuator through the at least one discharge orifice when the actuator is in a rest position.

2. The liquid dispensing package according to claim 1 wherein the pump assembly comprises a piston pump.

3. The liquid dispensing package according to claim 1 where in the through-pump drain-back of liquid from the actuator top surface drains back excess liquid not absorbed on a substrate.

4. The liquid dispensing package according to claim 1 wherein the pump chamber sidewall opening is below a piston head of a pump piston of the pump assembly when the pump piston is in a rest position.

5. The liquid dispensing package according to claim 1 wherein the pump chamber sidewall opening is above a piston head of a pump piston of the pump assembly when the pump piston is in a rest position.

6. A liquid dispensing package comprising:

a container adapted to contain a liquid;

an actuator having an actuator top surface;

a pump assembly comprising a pump chamber with a pump chamber sidewall having a pump chamber sidewall opening therethrough, an outlet valve controlling fluid flow through the pump chamber, and a pump piston for pressurizing fluid within the pump chamber and having a piston head and a piston opening in the piston head;

wherein the pump assembly is disposed within the container and has a discharge tube coupled to the actuator, the discharge tube being in fluid communication with the actuator top surface through at least one discharge orifice to permit liquid to flow onto the actuator top surface upon downward motion of the actuator from a rest position;

wherein the discharge tube is fluidly connected to the pump chamber sidewall opening which is fluidly connected to the container when the actuator is in the rest position;

wherein the pump chamber includes a pump chamber sidewall opening check valve at the pump chamber sidewall opening to prevent liquid flow from the container directly through the pump chamber sidewall opening;

wherein the at least one discharge orifice permits liquid to flow by gravity from the actuator top surface to the container through the discharge tube and through the pump chamber sidewall opening when the actuator is in the rest position.

7. The liquid dispensing package according to claim 6 wherein the pump chamber sidewall opening is above the piston head of the pump assembly when the actuator is in the rest position.

8. The liquid dispensing package according to claim 6 wherein the pump chamber sidewall opening is below the piston head of the pump assembly when the actuator is in the rest position.

* * * * *